US007938388B2

(12) United States Patent
Fujii et al.

(10) Patent No.: US 7,938,388 B2
(45) Date of Patent: May 10, 2011

(54) SHEET PROCESSING APPARATUS AND IMAGE FORMING APPARATUS

(75) Inventors: Takayuki Fujii, Tokyo (JP); Manabu Yamauchi, Kashiwa (JP); Shunsuke Nishimura, Toride (JP); Toshiyuki Miyake, Toride (JP); Hidenori Matsumoto, Kashiwa (JP); Yushi Oka, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 384 days.

(21) Appl. No.: 12/251,785

(22) Filed: Oct. 15, 2008

(65) Prior Publication Data

US 2009/0103962 A1 Apr. 23, 2009

(30) Foreign Application Priority Data

Oct. 22, 2007 (JP) ..... 2007-273658
Oct. 1, 2008 (JP) ..... 2008-255882

(51) Int. Cl.
*B65H 37/04* (2006.01)

(52) U.S. Cl. ..... 270/45; 270/20.1; 270/32; 270/51; 270/58.07

(58) Field of Classification Search ..... 270/20.1, 270/32, 45, 51, 58.07; 412/22, 30
See application file for complete search history.

(56) References Cited

U.S. PATENT DOCUMENTS

| | | | | |
|---|---|---|---|---|
| 5,870,627 | A * | 2/1999 | O'Toole et al. | 710/22 |
| 7,325,799 | B2 | 2/2008 | Watkiss | |
| 7,431,274 | B2 | 10/2008 | Kushida et al. | |
| 7,562,866 | B2 * | 7/2009 | Hayashi | 270/58.07 |
| 7,594,645 | B2 * | 9/2009 | Suzuki et al. | 270/37 |
| 7,726,638 | B2 * | 6/2010 | Itagaki | 270/32 |
| 2004/0104525 | A1 * | 6/2004 | Suzuki et al. | 270/32 |
| 2005/0189688 | A1 * | 9/2005 | Suzuki et al. | 270/32 |
| 2007/0060459 | A1 * | 3/2007 | Hayashi | 493/434 |

FOREIGN PATENT DOCUMENTS

| | | |
|---|---|---|
| JP | 2004-345863 A | 12/2004 |
| JP | 2005-239414 A | 9/2005 |
| JP | 2006-290588 A | 10/2006 |

* cited by examiner

*Primary Examiner* — Leslie A Nicholson, III
(74) *Attorney, Agent, or Firm* — Fitzpatrick, Cella, Harper & Scinto

(57) ABSTRACT

A sheet processing apparatus includes a folding apparatus which folds a sheet bundle, a switching portion which switches a nipping pressure of the folding apparatus against the sheet bundle, and a flattening apparatus which presses and flattens a folded-back portion of the folded sheet bundle. The switching portion operates such that the nipping pressure of the folding apparatus against the sheet bundle when the flattening processing is executed becomes weaker than that of the folding apparatus when the flattening processing is not executed.

6 Claims, 25 Drawing Sheets

SHEET PROCESSING APPARATUS AND IMAGE FORMING APPARATUS

BACKGROUND OF THE INVENTION

1. Field of the Invention

The present invention relates to a sheet processing apparatus capable of flattening a folded-back portion of a saddle-stitched sheet bundle, and to an image forming apparatus having the sheet processing apparatus.

2. Description of Related Art

There is proposed a sheet processing apparatus which saddle-stitches a plurality of piled sheets on which images are formed by an image forming apparatus. There is proposed an apparatus capable of pressing a folded-back surface (stitched side) of a saddle-stitched sheet bundle with a roller, and capable of flattening the same as shown in FIG. 25 (Japanese Patent Application Laid-open No. 2004-345863).

In an image forming apparatus such as a copier, there is proposed an image forming system which produces sheets output from the image forming apparatus as a saddled-stitched and bound material by a sheet processing apparatus having a saddle-stitching and binding mechanism and a flattening mechanism (Japanese Patent Application Laid-open No. 2005-239414).

Further, in an image forming apparatus such as a copier, there is proposed a sheet processing apparatus which controls the flattening processing such that a protruding amount of a folded-back portion of a sheet bundle is changed in accordance with a thickness of the sheet bundle so that the folded back width is suitable for the thickness (Japanese Patent Application Laid-open No. 2006-290588).

In the saddle-stitching or center-folding binding operation, if a finished booklet is left as it is, the booklet is slightly opened and its appearance is deteriorated in some cases. To prevent this, there is conceived a structure for increasing a folding pressure at the time of center-folding operation.

However, when a folded-back surface of the center-folded and bound booklet is flattened to form a spine, if a center-folding pressure is too strong, a center-folded crease 980 remains on a spine as shown in FIG. 25 and a finished appearance of the spine is deteriorated in some cases. Especially when an image is formed on a spine, there is a possibility that the image is cracked along the crease and the finished appearance is deteriorated.

Depending upon whether the flattening processing should be performed, techniques required for the center-folding processing are completely different, but selections as to whether the flattening processing should be performed are varied depending upon a booklet style desired by a user.

SUMMARY OF THE INVENTION

The present invention has been accomplished in view of the above points, and the invention provides a sheet processing apparatus and an image forming apparatus capable of changing a center-folding pressure in accordance with whether the flattening processing should be performed.

A sheet processing apparatus of the present invention comprises: a folding unit which nips and folds a sheet bundle; and a flattening unit which presses a folded-back portion of the sheet bundle folded by the folding unit, thereby flattening the folded-back portion; and a switching portion which switches a nipping pressure of the folding unit against the sheet bundle, the switching portion switches so that the nipping pressure, when the flattening processing is set, is smaller than that when the flattening processing is not set.

An image forming apparatus of the invention comprises: an image forming portion which forms an image on a sheet; and the sheet processing apparatus which folds the sheet on which the image is formed by the image forming portion into two and flattens the sheet.

In this invention, by changing the nipping pressure depending upon whether the flattening processing of a sheet bundle should be performed, it is possible to effectively eliminate a case where a crease remains on a surface of a spine. With this, it is possible to prevent an image on a spine from becoming cracked.

Further features of the present invention will become apparent from the following description of exemplary embodiments (with reference to the attached drawings).

DESCRIPTION OF THE EMBODIMENTS

A sheet processing apparatus and an image forming apparatus according to an embodiment of the present invention will be described concretely with reference to the drawings.

First Embodiment (Entire Structure)

Figure 1:
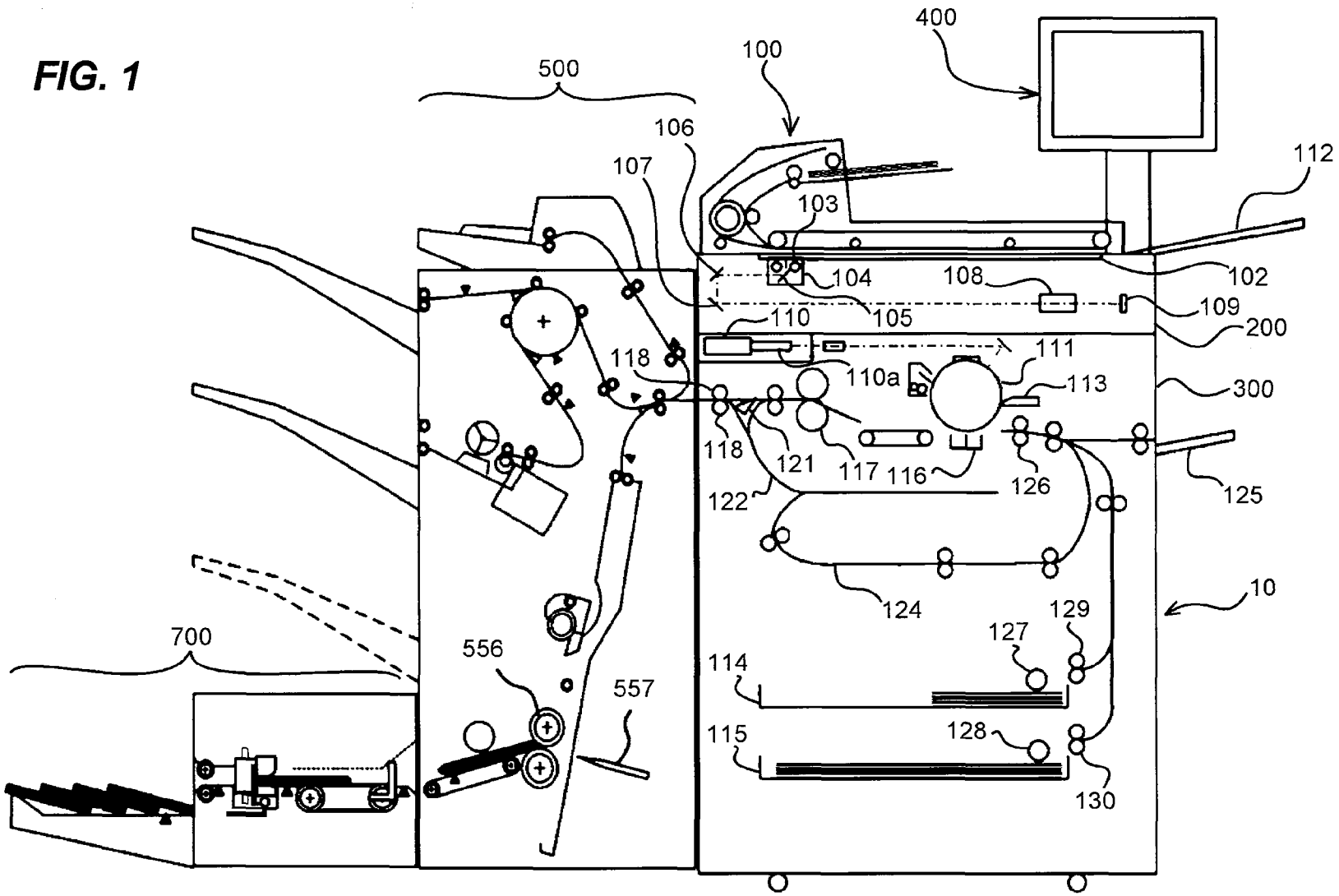
FIG. 1 is a diagram illustrating the entire structure.

FIG. 1 is a diagram showing the entire essential structure of an embodiment of the image forming apparatus of the invention.

As shown in FIG. 1, the image forming apparatus includes an image forming apparatus main body 10 and a sheet processing apparatus. The sheet processing apparatus includes a finisher 500 and a flattening apparatus 700. The image forming apparatus main body 10 includes an image reader 200 which reads an image of an original, and a printer 300 having an image forming portion which forms an image on a sheet.

The image reader 200 is provided with an original supply apparatus 100. Originals are set in the original tray 101 such that the originals are directed upward. The original supply apparatus 100 supplies the originals from the top page one sheet by one sheet leftward, and the original supply apparatus 100 conveys the originals on a platen glass 102 through a curved path from left to right through a flowing reading position and then, discharges the originals toward an outside discharge tray 112. When the originals pass through the flowing and reading position from left to right, an image of the original is read by a scanner unit 104 held at a position corresponding to the flowing and reading position. This reading method is generally called "original skim through". More specifically, when the original passes through the flowing and reading position, an original reading surface is irradiated with light of a lamp 103 of the scanner unit 104, and reflection light from the original is introduced into a lens 108 through mirrors 105, 106 and 107. Light which passes through the lens 108 forms an image on an image pickup surface of an image sensor 109.

By conveying originals such that they pass through the flowing and reading position from left to right in this manner, an original reading scanning is performed such that a direction perpendicular to the conveying direction of originals is a main scanning direction and the conveying direction is a sub-scanning direction. That is, when an original passes through the flowing and reading position, the original is conveyed in the sub-scanning direction while reading the original image in the main scanning direction one line by one line by the image sensor 109. With this, the entire original image is read, and the optically read image is converted into image data and output by the image sensor 109. The image data which is output from the image sensor 109 is subjected to a predetermined processing in a later-described image signal control device and then is input to an exposure control device 110 of the printer 300 as a video signal.

It is also possible to convey an original by the original supply apparatus 100 onto the platen glass 102 and stop the original at a predetermined position, and to allow the scanner unit 104 to scan the original from left to right in this state, thereby reading the original. This reading method is so-called original stationary reading.

When an original is read without using the original supply apparatus 100, a user first brings up the original supply apparatus 100 and places the original on the platen glass 102, and allows the scanner unit 104 to scan the original from left to right, thereby reading the original. That is, when an original is read without using the original supply apparatus 100, the original stationary reading is performed.

The exposure control device 110 of the printer 300 modulates laser light based on an input video signal, and outputs the same, and the laser light is scanned by the polygon mirror 110*a* and a photosensitive drum 111 is irradiated with the light. An electrostatic latent image corresponding to the scanned laser light is formed on the photosensitive drum 111. As will be described later, the exposure control device 110 outputs laser light such that a correct image (not a mirror image) is formed at the time of original stationary reading.

The electrostatic latent image on the photosensitive drum 111 is visualized as a developer image by a developer supplied from a developing device 113. Sheets are conveyed at timing in synchronization with start of irradiation of laser light from a conveyance portion comprising sheet rollers 127 and 128, separation rollers 129 and 130 and registration roller 126 from cassettes 114 and 115, a manually supplying portion 125 or a duplex conveying path 124. The sheet is conveyed between the photosensitive drum 111 and the transfer portion 116. The developer image formed on the photosensitive drum 111 is transferred onto a sheet supplied from the transfer portion 116.

A sheet on which a developer image is transferred is conveyed to the fixing portion 117. The fixing portion 117 heats and pressurizes the sheet, thereby fixing the developer image onto the sheet. A sheet which passes through the fixing portion 117 is discharged out (finisher 500) from the printer 300 through a switching member 121 and a discharge roller 118. The switching member 121 changes the conveying direction.

When a sheet is discharged in a state where an image formed surface thereof is oriented downward (face down), the sheet which passed through the fixing portion 117 is once introduced into a reverse path 122 by switching operation of the switching member 121. After a rear end of the sheet passed through the switching member 121, the sheet is switched back, and the sheet is discharged from the printer 300 by a discharge roller 118. This discharging style is called reverse discharge. This reverse discharge is performed when images are formed from top page in sequence, for example, when images which are read using the original supply apparatus 100 are formed, when images which are output from a computer are formed. The order of sheets after the discharge is the correct page order.

When hard sheets such as OHP sheets are sent from the manually supplying portion 125 and images are formed on these sheets, the sheets are discharged by the discharge roller 118 such that the image formed surface is oriented upward (face up) without introducing the sheet to the reverse path 122.

When double-sided image forming in which images are formed on both surfaces of a sheet is set, a sheet is introduced into the reverse path 122 by switching operation of the switching member 121 and the sheet is conveyed to the duplex conveying path 124. Control is performed such that a sheet introduced to the duplex conveying path 124 is again sent between the photosensitive drum 111 and the transfer portion 116 at the above-described timing.

A sheet discharged from the printer 300 is sent to the finisher 500. The finisher 500 performs various processing such as stitching processing, and the flattening apparatus 700 as a flattening unit crimps a center-folded surface which is stitched or folded, thereby performing the flattening processing.

(System Block Diagram)

Figure 2:
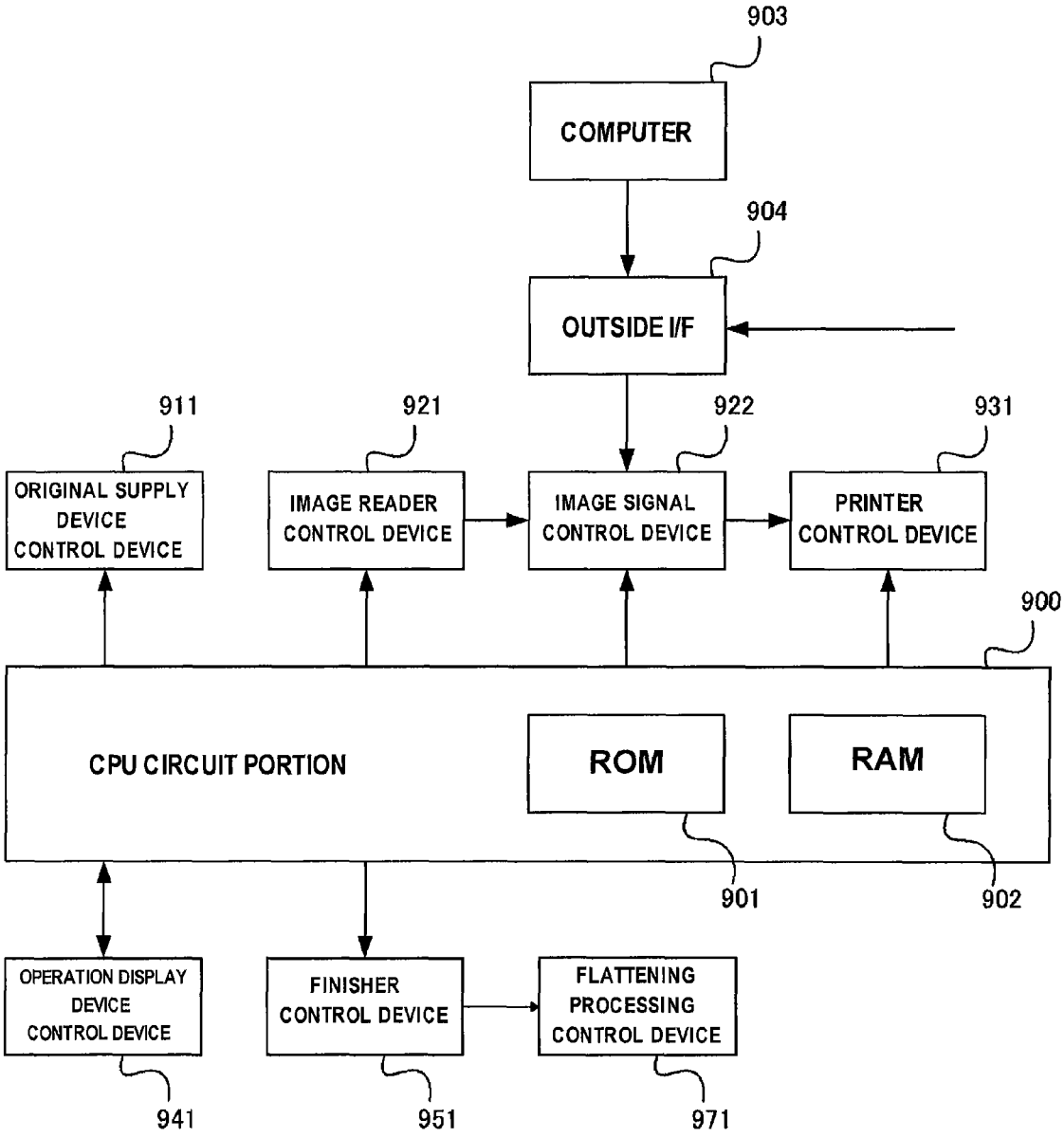
FIG. 2 is a block diagram illustrating the entire structure of a controller which controls the entire image forming apparatus shown in FIG. 1.

Next, a structure of a controller which controls the entire image forming apparatus will be described with reference to FIG. 2. FIG. 2 is a block diagram showing the entire structure of the controller which controls the entire image forming apparatus shown in FIG. 1.

As shown in FIG. 2, the controller includes a CPU circuit portion 900. The CPU circuit portion 900 incorporates a CPU (not shown), a ROM 901 and a RAM 902. A control program stored in the ROM 901 collectively controls blocks, an original supply apparatus control device 911, an image reader control device 921, an image signal control device 922, a printer control device 931, an operation display device control device 941 and a finisher control device 951. The RAM 902 temporarily holds control data, and is used as a working area for computation processing caused by control.

The original supply apparatus control device 911 drives and control the original supply apparatus 100 based on instructions from the CPU circuit portion 900. The image reader control device 921 drives and controls the scanner unit 104 and the image sensor 109, and transfers an analog signal from the image sensor 109 to the image signal control device 922.

The image signal control device 922 converts an analog image signal from the image sensor 109 to a digital signal and performs various processing, and converts the digital signal to a video signal and outputs the same to the printer control device 931. Further, a digital image signal which is input from a computer 903 through an external I/F 904 is subjected to various processing, the digital image signal is converted into a video signal and this is output to the printer control device 931. The processing operation of the image signal control device 922 is controlled by the CPU circuit portion 900. The printer control device 931 drives the exposure control device 110 based on an input video signal.

The operation display device control device 941 exchanges information between an operation display device 400 (see FIG. 1) and the CPU circuit portion 900. The operation display device 400 includes a plurality of keys for setting various functions concerning image formation and a display portion for displaying information indicative of setting state. A key signal corresponding to operation of each key is output to the CPU circuit portion 900, and corresponding information is displayed on the display portion based on a signal from the CPU circuit portion 900.

The finisher 500 is provided with the finisher control device 951, the finisher control device 951 exchanges information with the CPU circuit portion 900, thereby driving and controlling the entire finisher. Control contents will be described later.

The flattening apparatus 700 is provided with a flattening process control device 971. The flattening process control device 971 exchanges information with the finisher control device 951 and drives and controls the flattening processing. This control will be described later.

(Operation Display Device)

Figure 3:
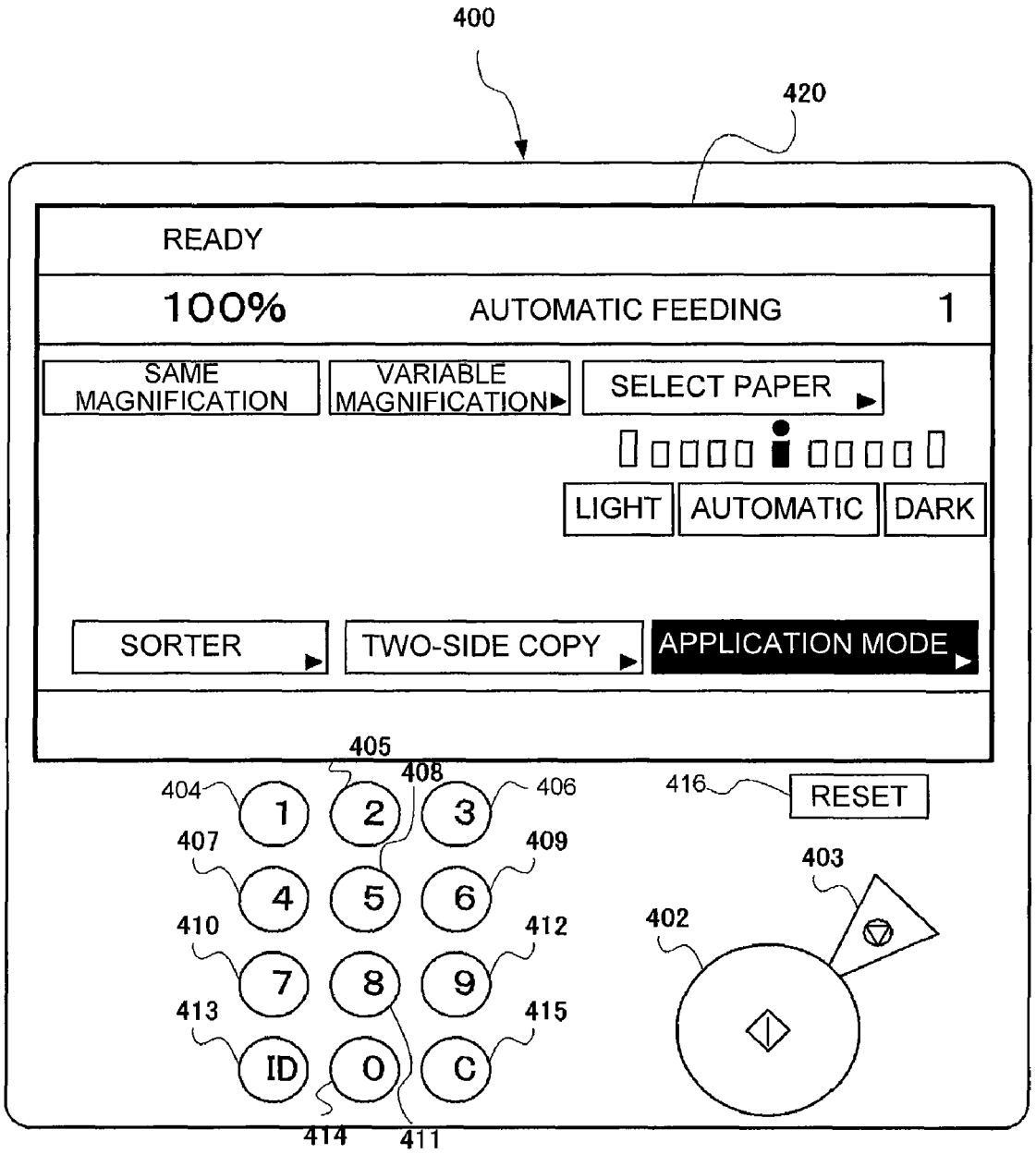
FIG. 3 is an explanatory diagram of an operation display portion.

FIG. 3 is a diagram showing the operation display device 400 in the image forming apparatus shown in FIG. 1. Disposed on the operation display device 400 area start key 402 for starting the image forming operation, a stop key 403 for temporarily suspending the image forming operation, numeric keys 404 to 412 and 414 for setting numbers, an ID key 413, a clear key 415, are set key 416 and a user mode key 417 for setting various devices. The operation display device 400 is provided at its upper portion with a liquid crystal display portion 420 formed with a touch panel, and soft keys can be formed on its screen.

As post-processing modes, the image forming apparatus has various processing modes such as a non-sort mode, a sort mode, a staple mode (stitching mode) and a binding mode. Such processing modes are set by input operation from the operation display device 400. When the post-processing mode is to be set, if a "sorter" which is a soft key is selected in an initial screen as shown in FIG. 3, a menu selection screen is displayed on the liquid crystal display portion 420, and the processing mode is set using the menu selection screen.

(Finisher)

Figure 4:
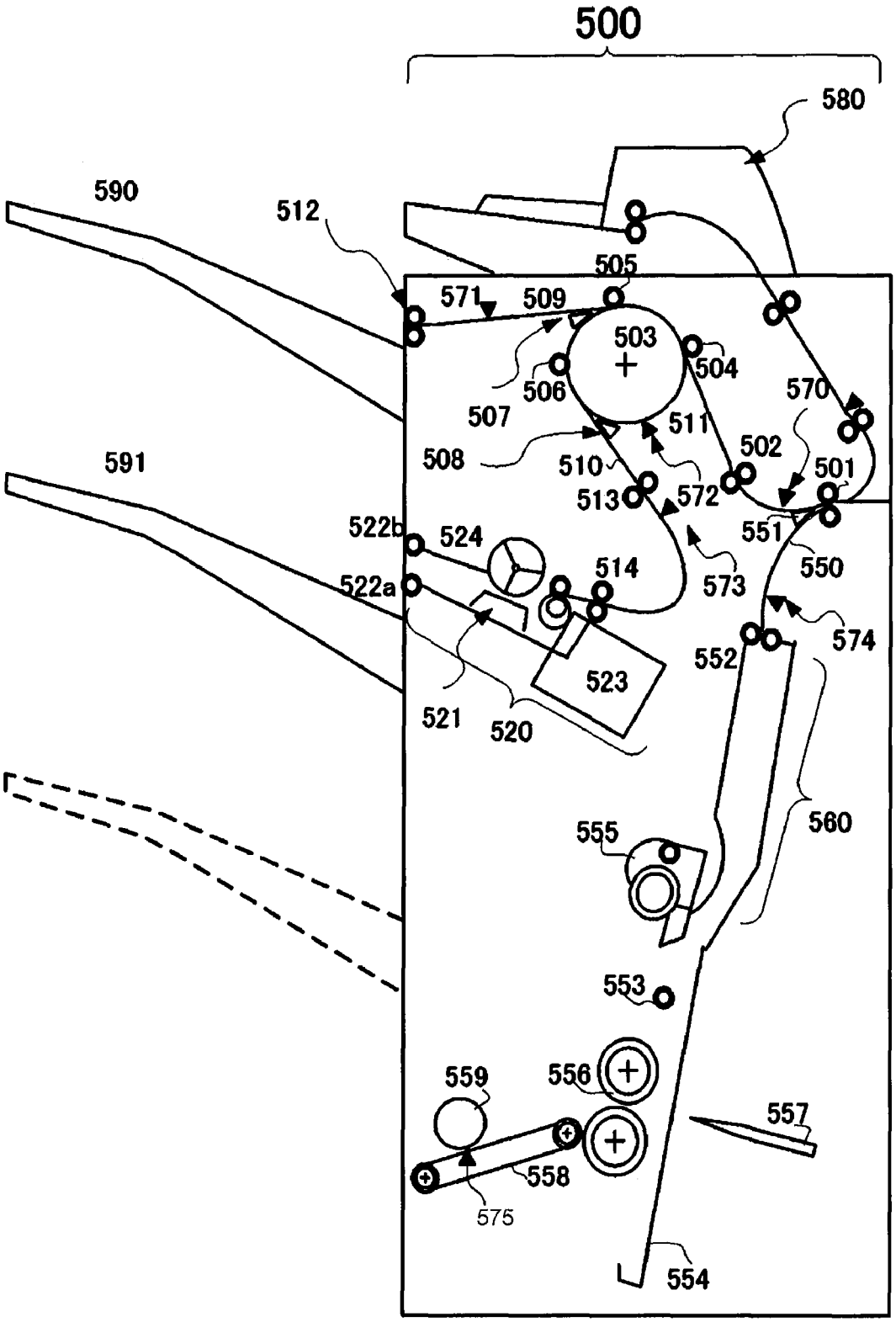
FIG. 4 is a sectional view of a finisher.

Next, a structure of the finisher 500 will be described with reference to FIG. 4. FIG. 4 is a sectional view of the finisher 500 shown in FIG. 1.

The finisher 500 performs processing for taking sheets discharged from the image forming apparatus main body 10 in sequence, aligning and binding the taken plurality of sheets into a sheet bundle, and performs the staple processing for binding rear ends of the bound sheet bundle with staples. The finisher 500 performs the sheet post-processing such as punching processing for punching rear ends of taken sheets, sort processing, non-sort processing and binding processing.

As shown in FIG. 4, according to the finisher 500, a sheet discharged from the image forming apparatus main body 10 is taken in by a pair of inlet rollers 501, and the sheet take in by the pair of inlet rollers 501 is sent toward a buffer roller 503 through a pair of conveying rollers 502. An inlet sensor 570 is provided in an intermediate portion of the conveying path between the pair of inlet rollers 501 and the pair of conveying rollers 502.

A switching member 551 is disposed downstream of the pair of inlet rollers 501. The switching member 551 switches between a path to a sort path 510 and a non-sort path 509, and a path to a binding path 550.

A predetermined number of sheets sent through the pair of conveying rollers 502 can be laminated and wound around an outer periphery of the buffer roller 503. While the buffer roller 503 rotates, sheets are wound around the outer periphery of the buffer roller 503 by push-down rollers 504, 505 and 506. The wound sheets are conveyed in the rotation direction of the buffer roller 503.

A switching member 507 is disposed between the push-down rollers 505 and 506, and a switching member 508 is disposed downstream of the push-down roller 506. The switching member 507 peels off a sheet wound around the buffer roller 503 from the buffer roller 503, and introduces the sheet to the non-sort path 509 or the sort path 510. The switching member 508 peels a sheet wound around the buffer roller 503 from the buffer roller 503 and introduces the sheet to the sort path 510 or introduces the sheet to a buffer path 511 in a state where the sheet is wound around the buffer roller 503.

When the sheet wound around the buffer roller 503 is introduced to the non-sort path 509, the switching member 507 is operated to peel the sheet off from the buffer roller 503, and the sheet is introduced to the non-sort path 509. The sheet introduced to the non-sort path 509 is discharged onto a sample tray 590 through a pair of discharge rollers 512. A discharge path sensor 571 is provided in an intermediate portion of the non-sort path 509.

When a sheet wound around the buffer roller 503 is introduced to a buffer path 511, the switching member 507 and the switching member 508 are not operated, and the sheet is sent to the buffer path 511 in a state where the sheet is wound around the buffer roller 503. A buffer path sensor 572 for detecting a sheet on the buffer path 511 is provided in an intermediate portion of the buffer path 511.

When a sheet wound around the buffer roller 503 is introduced to the sort path 510, the switching member 507 is not operated but the switching member 508 is operated, the sheet is peeled off from the buffer roller 503 and the sheet is introduced to the sort path 510. The sheet introduced to the sort path 510 is placed on a processing tray 520 through the pair of conveying rollers 513 and 514. A sort path sensor 573 is provided downstream of the pair of conveying rollers 513.

A sheet bundle placed on the processing tray 520 is subjected to aligning processing by aligning members 521 provided on a front side and a deep side and subjected to staple processing as necessary. Then, the sheets are discharged onto a stack tray 591 by a pair of discharge rollers 522*a* and 522*b*. The discharge roller 522*b* is supported by a rock guide 524, and the rock guide 524 rocks such that the discharge roller 522*b* abuts against the top sheet on the processing tray 520 by a rock motor (not shown). In a state where the discharge roller 522*b* is in abutment against the top sheet on the processing tray 520, the discharge roller 522*b* cooperates with the discharge roller 522*a* and discharges a sheet bundle on the processing tray 520 toward the stack tray 591.

The staple processing is performed by a stapler 523. The stapler 523 can move along an outer periphery of the processing tray 520, and can bind a sheet bundle placed on the processing tray 520 at the rearmost end (rear end) of the sheets in the sheet conveying direction.

A sheet introduced to the binding path 550 is conveyed to a binding processing tray 560 through a pair of conveying rollers 552. A binding inlet path sensor 574 is provided in an intermediate portion of the binding path 550. The binding processing tray 560 is provided with an intermediate roller 553 and a movable sheet positioning member 554.

An anvil (not shown) is provided at a position opposed to a stapler 555. The stapler 555 and the anvil cooperate with each other to perform the staple processing for a sheet bundle accommodated in the binding processing tray 560.

A folding unit for folding a sheet bundle is provided downstream of the stapler 555.

The folding unit includes a pair of folding rollers 556 and an extruding member 557 located at a position opposed to the pair of folding rollers 556. The extruding member 557 extrudes toward a sheet bundle accommodated in the binding processing tray 560. With this, the extruding member 557 extrudes the sheet bundle laminated and accommodated in the binding processing tray 560 in between the pair of folding rollers. The pair of folding rollers 556 folds the sheet bundle and conveys them toward downstream. The folded sheet bundle is delivered to a downstream apparatus through a conveying belt 558.

An auxiliary roller 559 abuts against the conveying belt 558 upstream of the conveying belt 558 in a state where the auxiliary roller 559 is biased by a spring. A path sensor 575 is provided above the conveying belt 558.

The pair of folding rollers 556 can switch between a separating state and a crimping state in accordance with a later-described flattening processing.

(Block Diagram of Finisher)

Figure 5:
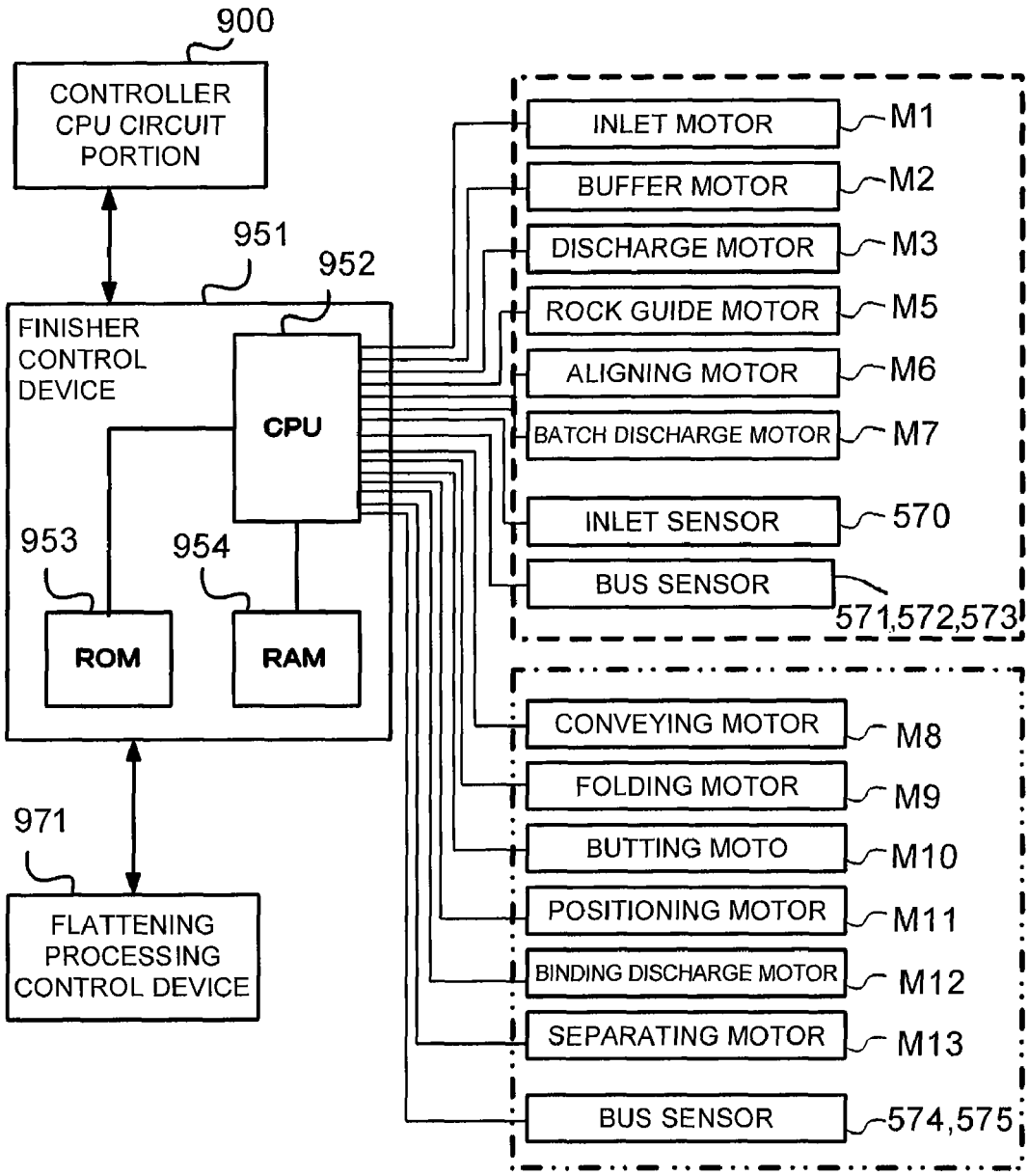
FIG. 5 is a block diagram of the finisher.

Next, a structure of a finisher control device 951 which drives and controls the finisher 500 will be described with reference to FIG. 5. FIG. 5 is a block diagram showing a structure of the finisher control device 951 in FIG. 2.

As shown in FIG. 5, the finisher control device 951 includes a CPU 952, a ROM 953 and a RAM 954. The finisher control device 951 communicates with a CPU circuit portion 900 provided on the side of the image forming apparatus main body 10 through a communication IC (not shown) and exchanges data therebetween, executes various programs stored in the ROM 953 based on instructions from the CPU circuit portion 900 and drives and controls the finisher 500.

In addition to the image forming apparatus main body 10, the finisher control device 951 communicates with a flattening process control device 971 which controls the flattening apparatus 700 as a flattening unit through the communication IC (not shown).

Concerning various input and output, there are provided an inlet motor M1 which drives a pair of inlet rollers 501 and a pair of conveying rollers 502, a buffer motor M2 for driving a buffer roller 503, and a discharge motor M3 for driving a pair of discharge rollers 512 and a pair of conveying rollers 513 and 514. As structures for driving various members of the processing tray 520, a discharge motor M7 for driving a pair of discharge rollers 522*a* and 522*b* is provided. There are also provided a rock guide motor M5 for vertically driving a rock guide 524, an aligning motor M6 for driving an aligning member 521, and a staple motor (not shown) for driving the stapler 523. There are also provided with input signals such as an inlet sensor 570 and path sensors 571, 572 and 573 for detecting passage of sheets.

As input and output as a binding function, there are provided a conveying motor M8 for driving a pair of conveying rollers 552, a folding motor M9 for driving a pair of folding rollers 556, and a butting motor M10 for driving the extruding member 557 which are surrounded by phantom lines in FIG. 5. There are also provided a positioning motor M11 for vertically driving the sheet positioning member 554, a binding discharge motor M12 for driving the conveying belt 558, a separating motor M13 for separating or crimping the pair of folding rollers 556, and path sensors 574 and 575.

(Binding Mode Operation)

Next, a flow of a sheet in the binding mode in the finisher 500 will be described.

A flow of a sheet at the time of the binding mode operation will be described with reference to FIGS. 6 to 10.

Figure 6:
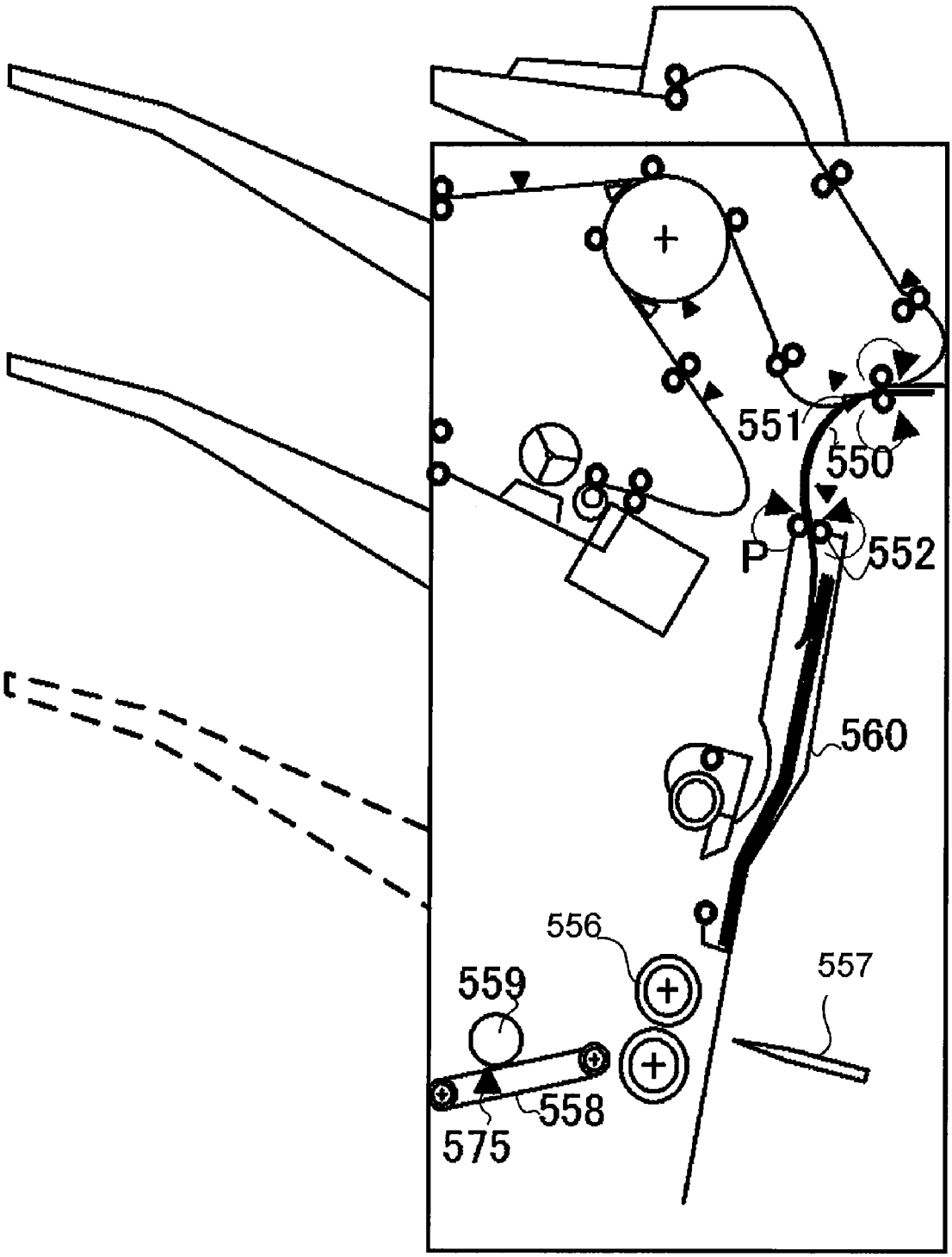
FIG. 6 is a diagram illustrating a flow of a paper sheet in the finisher at the time of a binding mode.

If the binding mode is designated, as shown in FIG. 6, the pair of inlet rollers 501 and the pair of conveying rollers 552 are rotated and driven by the inlet motor Ml and the conveying motor M8, and a sheet P discharged from the image forming apparatus main body 10 is taken into the finisher 500 and is conveyed. At that time, the switching member 551 is held in a state where the sheet P is introduced to the binding path 550 by a solenoid (not shown), and the sheet P is accommodated in the binding processing tray 560 by the pair of conveying rollers 552.

The intermediate roller 553 is rotated and driven, and a tip end of a sheet accommodated in the binding processing tray 560 is conveyed until it comes into contact with the sheet positioning member 554. If the tip end of the sheet reaches the positioning member and the conveying motion stops, the aligning member (not shown) moves in a direction perpendicular to the sheet conveying direction, and the aligning operation of sheets is performed.

The position of the sheet positioning member 554 at that time is changed in accordance with a size of a sheet P, and the sheet P is moved to a position at a predetermined distance X where a rear end of the sheet P passes over the pair of conveying rollers 552. That is, if a length of a sheet P in the conveying direction is defined as L1, a distance L from the pair of conveying rollers 552 to the sheet positioning member 554 is L1+X.

Figure 7:
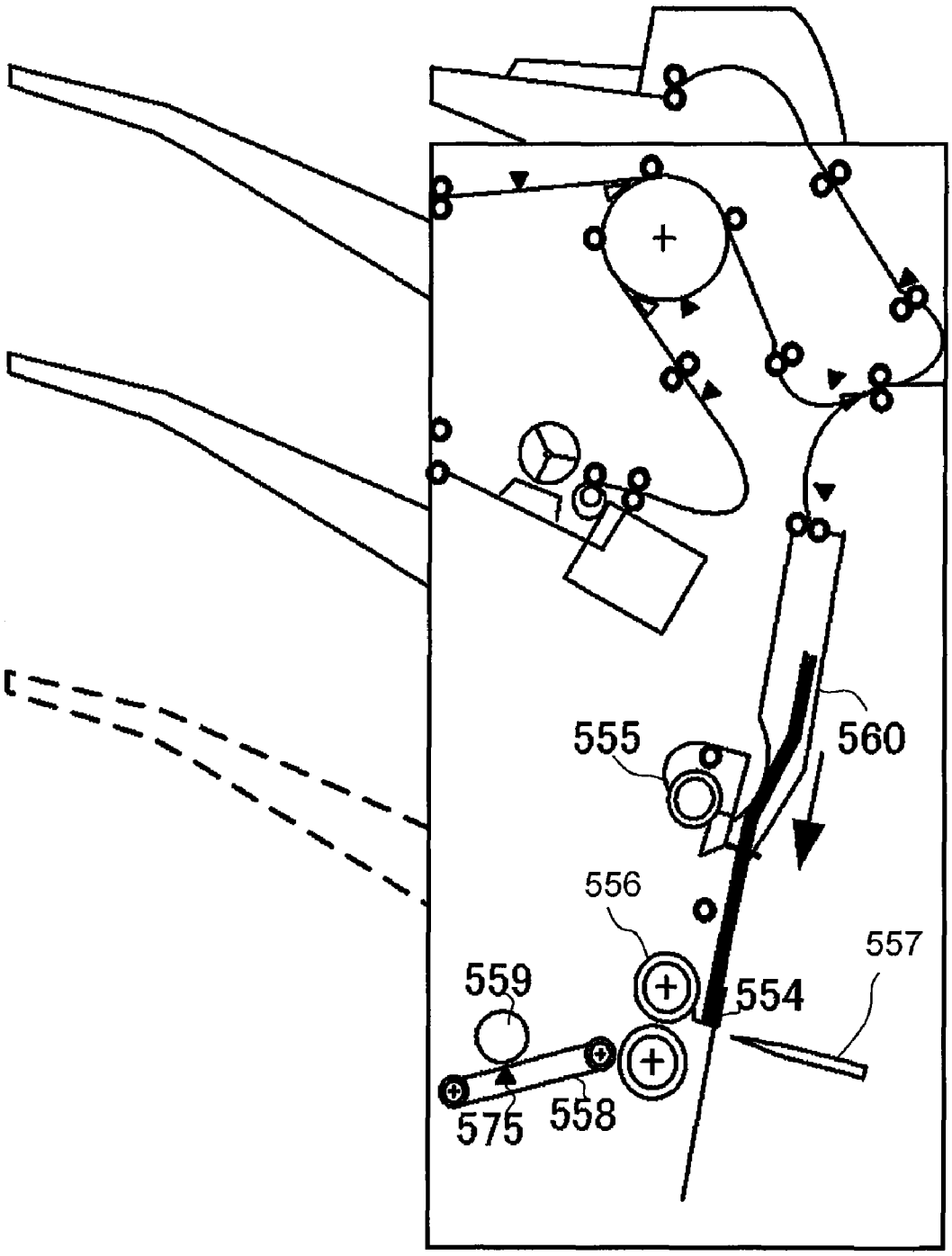
FIG. 7 is a diagram illustrating the flow of the paper sheet in the finisher at the time of a binding mode.

If a predetermined number of sheets are accommodated and aligned, as shown in FIG. 7, the sheet positioning member 554 is lowered and at the same time, the intermediate roller 553 is rotated and driven, and the intermediate roller 553 is moved to a position where central portions of the sheet bundle are stapled by the stapler 555. If the movement is completed, the central portion of the sheet bundle is stapled (stitched, hereinafter) by the stapler 555 as described above.

Figure 8:
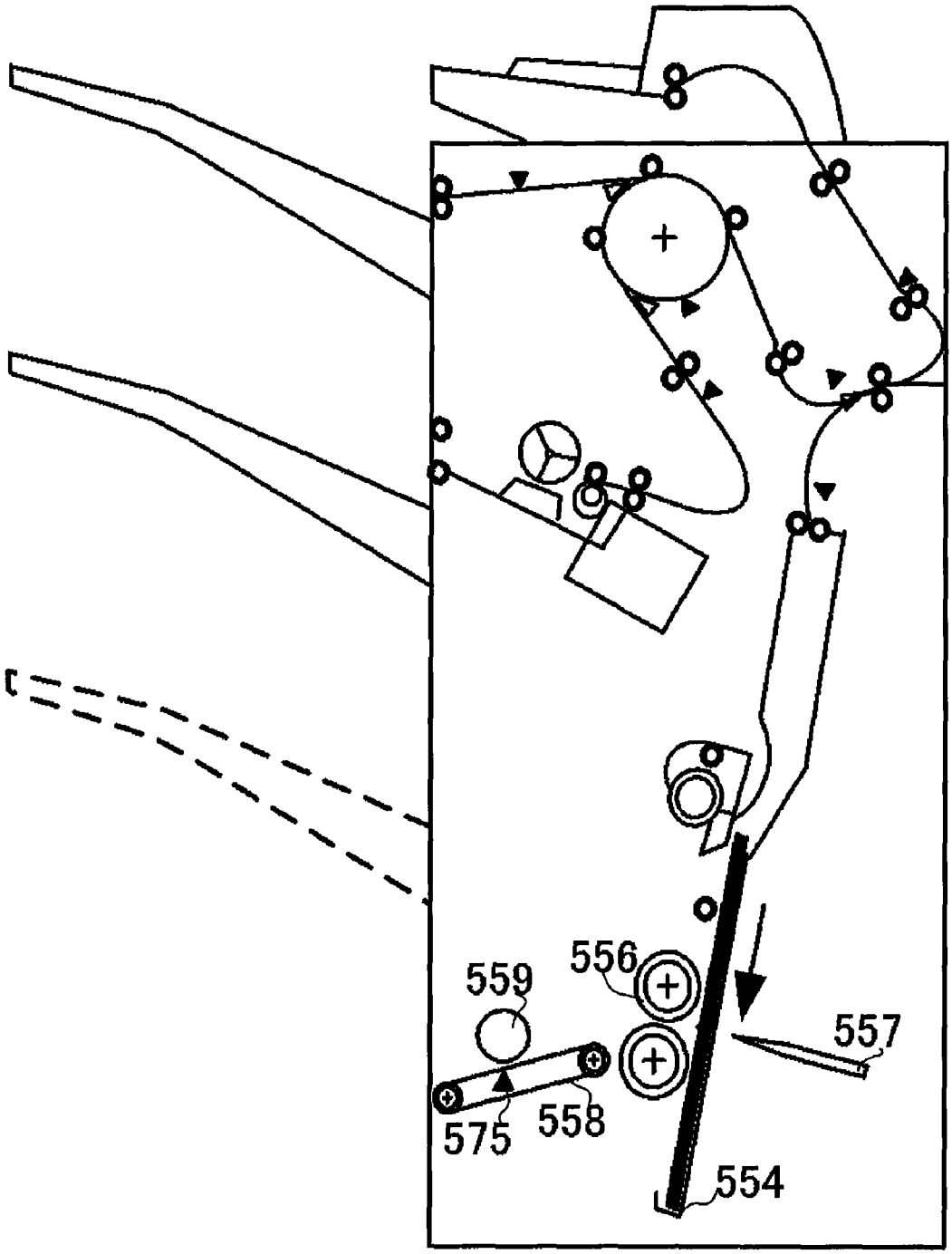
FIG. 8 is a diagram illustrating the flow of the paper sheet in the finisher at the time of a binding mode.
Figure 9:
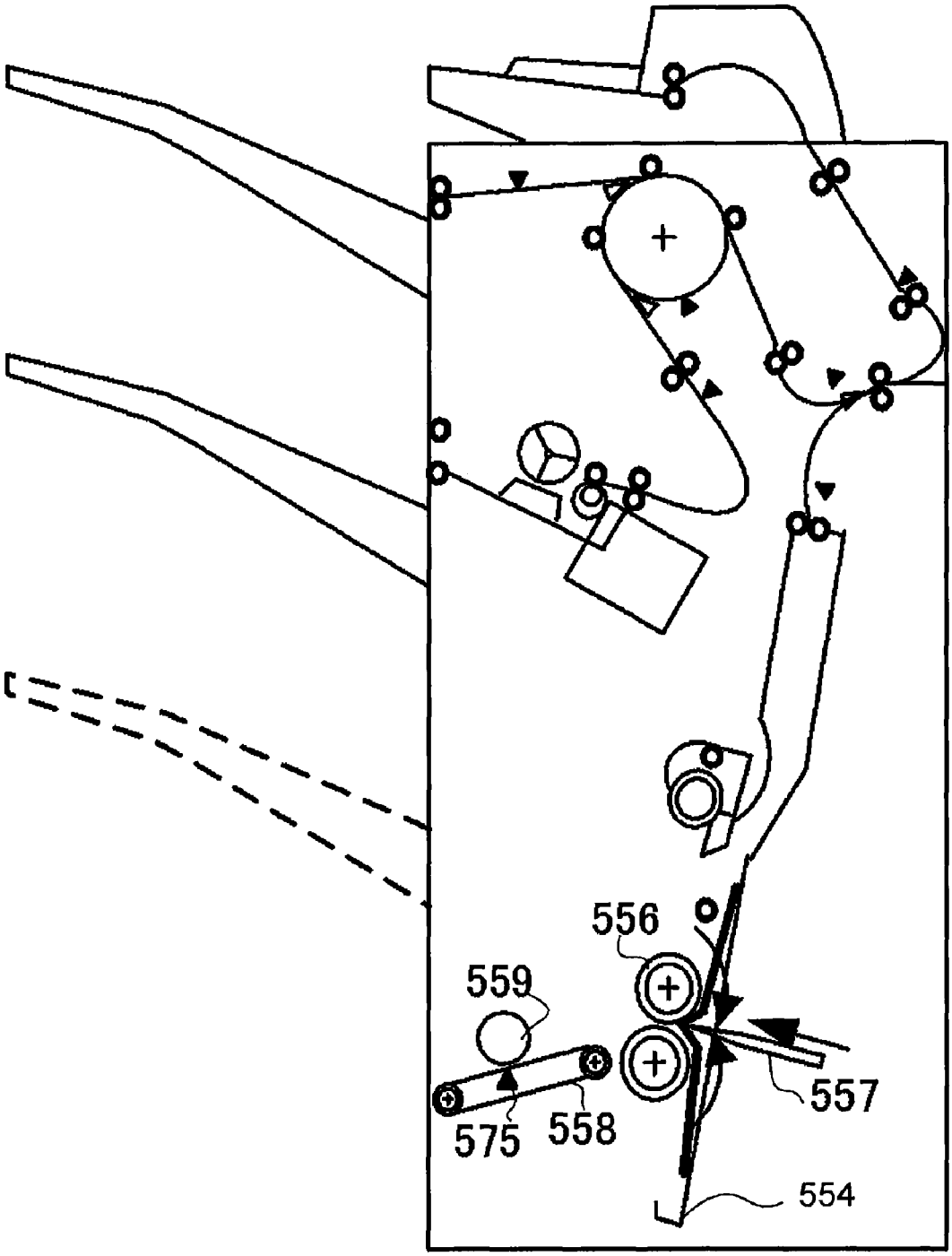
FIG. 9 is a diagram illustrating the flow of the paper sheet in the finisher at the time of a binding mode.

If the stitching operation is completed, as shown in FIG. 8, the sheet positioning member 554 is lowered and the intermediate roller 553 is rotated and driven at the same time, and the sheets are moved until central portions of the sheet bundle, i.e., staple positions, come to a central nip position of the pair of folding rollers 556. If the movement is completed, as shown in FIG. 9, the pair of folding rollers 556 and the pair of conveying rollers are rotated and driven by the folding motor M9 and the binding discharge motor M12 and at the same time, the extruding member 557 is driven by the butting motor M10 and the extruding member 557 extrudes to push the sheet bundle against the pair of folding rollers 556.

Figure 10:
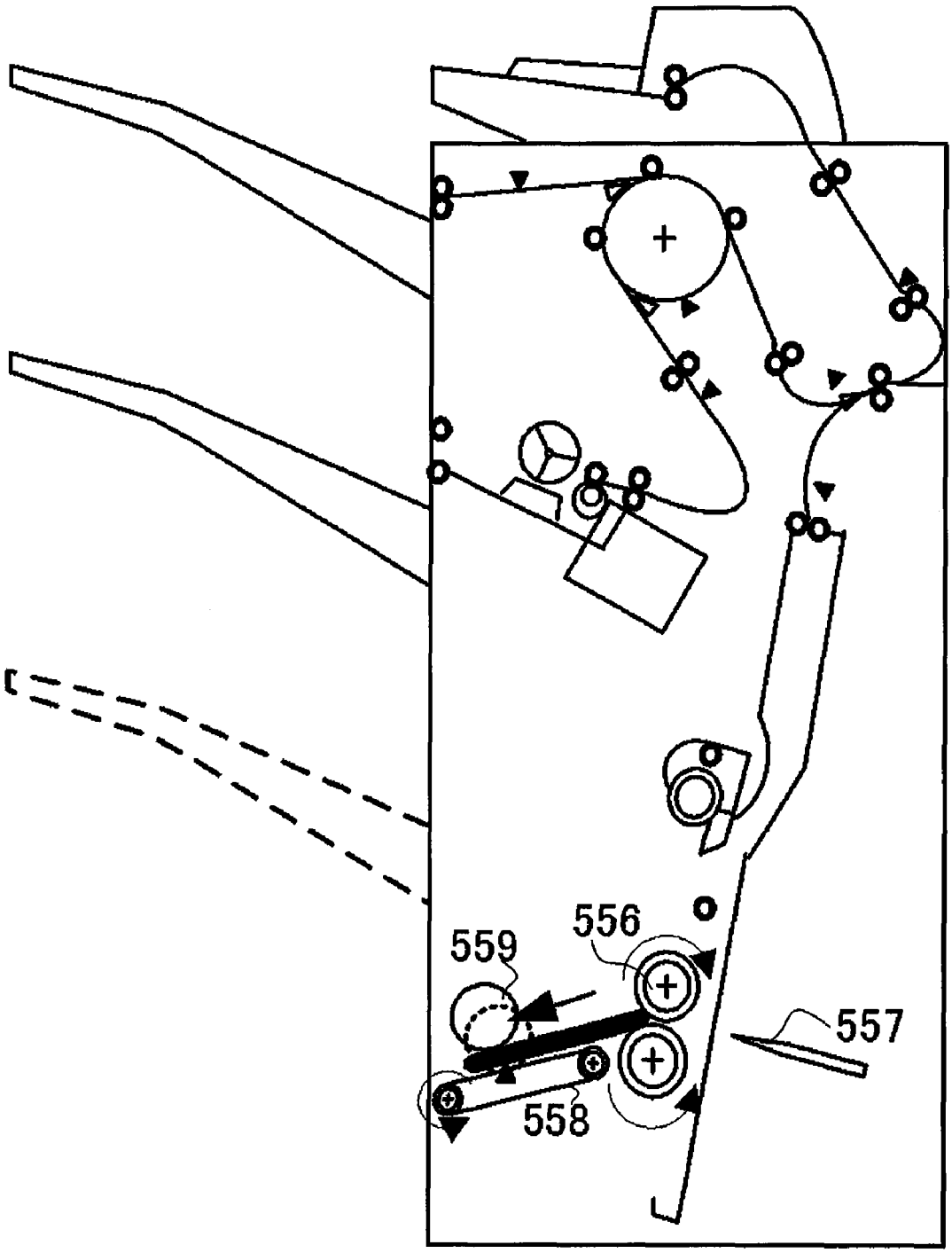
FIG. 10 is a diagram illustrating the flow of the paper sheet in the finisher at the time of a binding mode.

The sheet bundle pushed out by the pair of folding rollers 556 is folded and conveyed downstream as shown in FIG. 10, and the sheets are discharged toward the flattening apparatus by the conveying belt 558. The auxiliary roller 559 provided on the upper side of the conveying belt 558 is biased such that it abuts against the conveying belt 558, and if the sheet bundle reaches the auxiliary roller 559, the auxiliary roller 559 is lifted in accordance with the thickness of the sheet bundle. In this embodiment, the central portions of the sheet bundle are stitched by staples and then, the sheets are folded into two at the staple position, and so-called stitched and bound sheet bundle will be described. However, the present invention can also be applied to a sheet bundle which is only folded into two without being stitched.

(Flattening Apparatus)

Figure 11A:
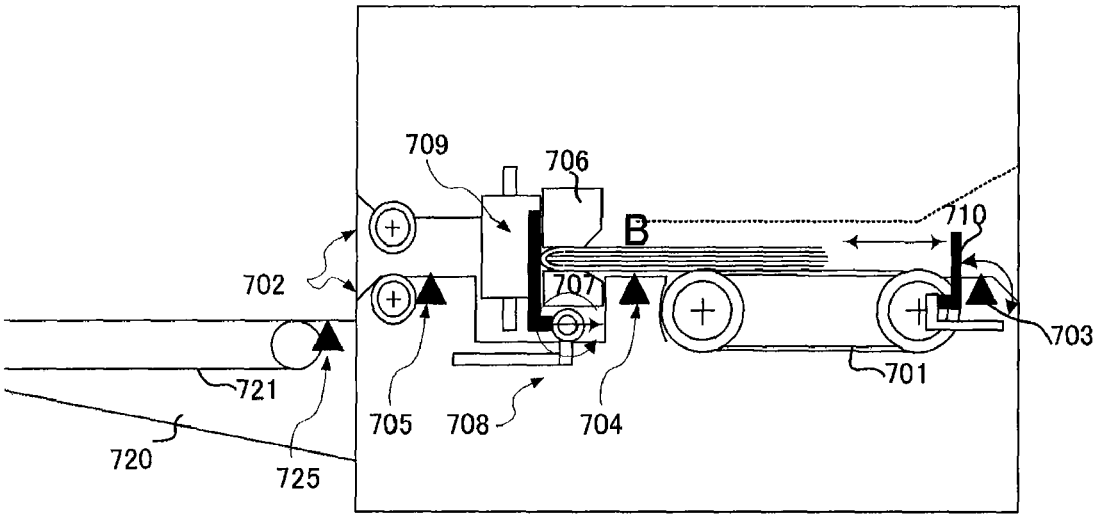
FIGS. 11A and 11B are a sectional view and a plan view, respectively, of a flattening apparatus.
Figure 11B:
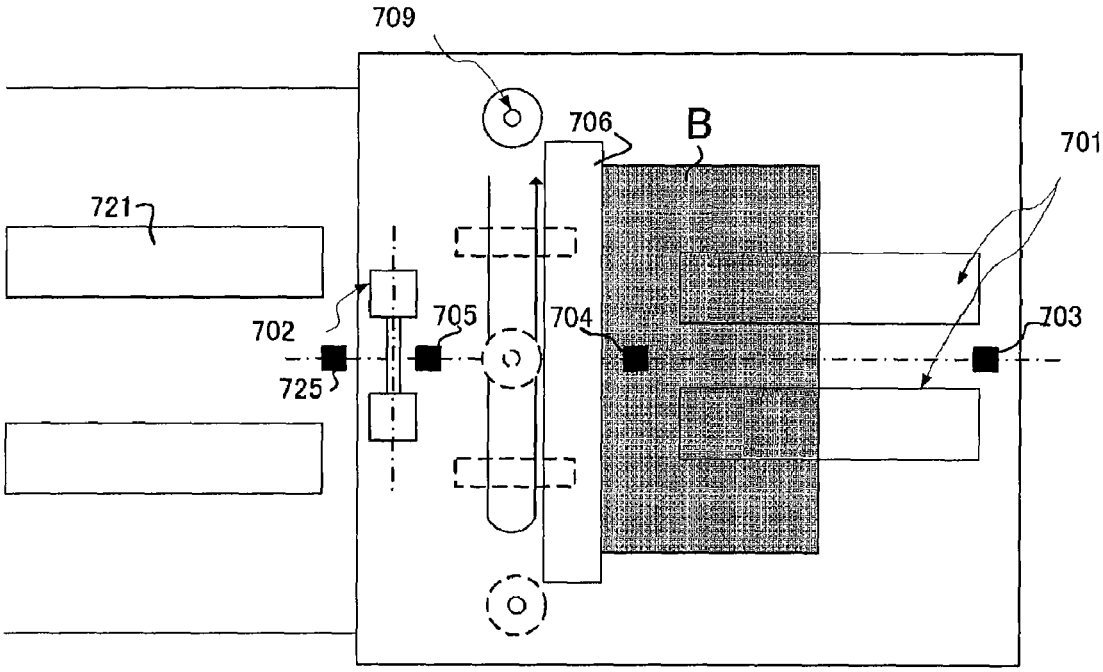

Next, the flattening apparatus 700 as a flattening unit for pressing and flattening a folded-back portion of a folded sheet bundle will be described with reference to FIGS. 11A and 11B. FIGS. 11A and 11B area sectional view and a plan view, respectively, of the flattening apparatus 700 shown in FIG. 1.

The flattening apparatus 700 receives a sheet bundle B which is stitched and folded by a binding processing portion of the finisher 500, and conveys the sheets downstream by a conveying belt 701. When the sheet bundle B on the conveying belt 701 is conveyed, an assist member 710 assists rear ends of the sheet bundle B. When a surface resistance of a bottom sheet of the sheet bundle B is low, the sheet bundle B is prevented from slipping on the conveying belt 701.

A registration removing stopper 708 for removing the inclination of the received sheet bundle B is provided downstream of the conveying belt 701. If the inclination removing operation is completed, the registration removing stopper 708 is rotated around a rotation shaft 708*a* and retreated so that the sheet bundle B is delivered to the discharge conveying roller 702.

The sheet bundle B whose inclination was corrected by the registration removing stopper 708 is gripped by a fixed lower grip 707 and a vertically movable upper gripper 706.

The registration removing stopper 708 can move in the sheet conveying direction. A grip position of the sheet bundle B in the conveying direction adjusts a protruding amount of a sheet bundle B from the gripper on the folding side by adjusting the registration removing position of the registration removing stopper 708.

A sheet bundle fixed by the lower grip 707 and the upper gripper 706 is flattened by moving a crimping roller 709 for flattening processing from a deep side to a front side of the apparatus and by pressing the folded surface of the sheet bundle B protruding from the gripper.

Then, the sheet bundle B is loaded on a loading tray 720 through a discharge conveying roller 702. A conveyor belt 721 is provided on the loading tray 720, and the sheet bundle B is conveyed and loaded downstream.

When the flattening processing is not performed, the inclination is removed by the registration removing stopper 708, and the sheets are discharged to the loading tray 720 without performing the flattening processing by the crimping roller 709. When the flattening processing is not performed also, inclination of a sheet bundle generated when sheets are delivered from the finisher 500 the flattening apparatus 700 is removed so that alignment of sheet bundle on the loading tray 720 is enhanced.

(Block Diagram of Flattening Apparatus)

Figure 12:
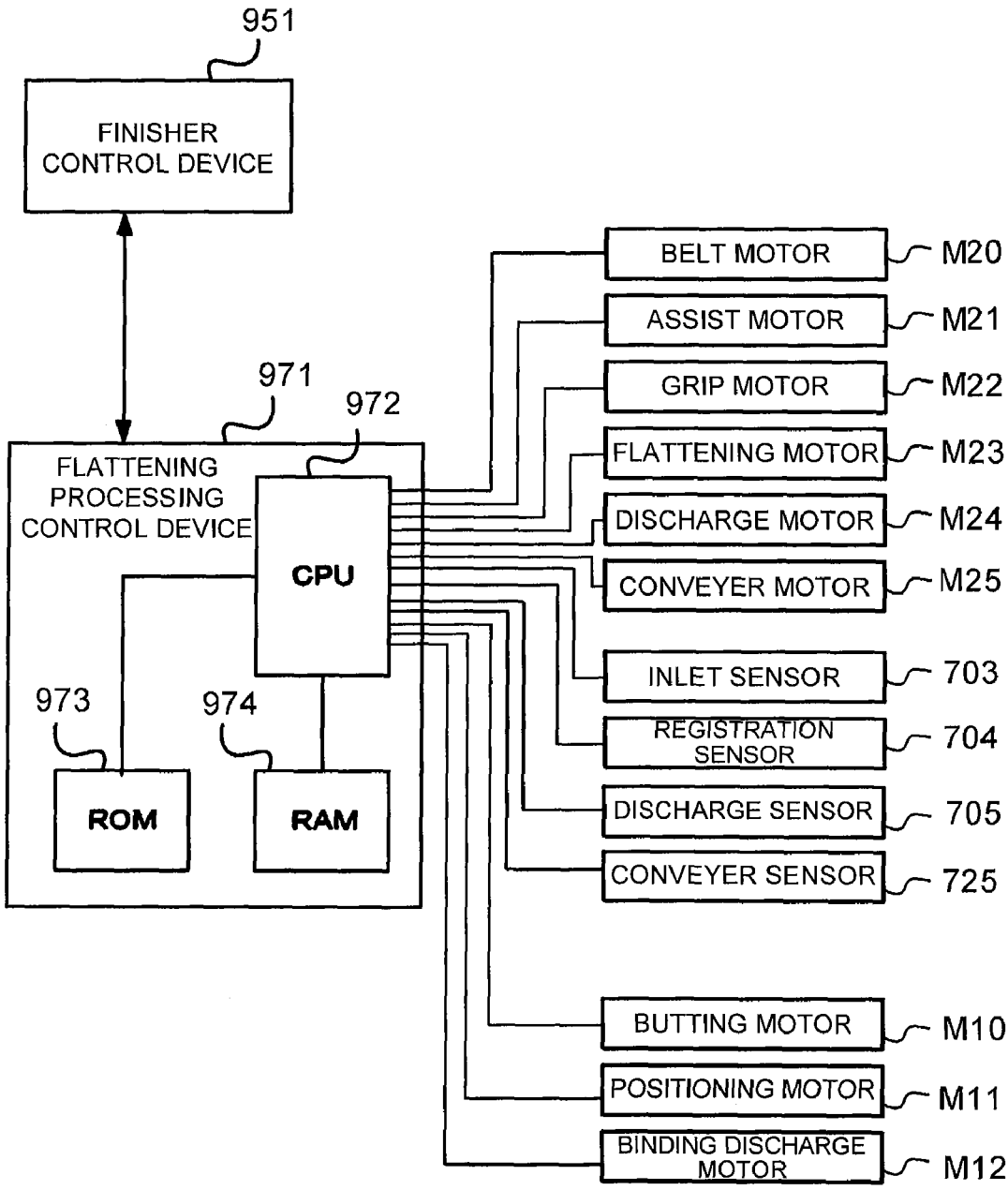
FIG. 12 is a block diagram of the flattening apparatus.

Next, a structure of the flattening process control device 971 which drives and controls the flattening apparatus 700 will be described with reference to FIG. 12. FIG. 12 is a block diagram showing a structure of the flattening process control device 971 shown in FIG. 2.

As shown in FIG. 12, the flattening process control device 971 includes a CPU 972, a ROM 973 and a RAM 974. The flattening process control device 971 communicates with the finisher control device 951 provided on the side of the finisher 500 through a communication IC (not shown) and exchanges data therebetween, executes various programs stored in the ROM 973 based on instructions from the finisher control device 951, and drives and controls the flattening apparatus 700.

Concerning various input and output, there are provided a belt motor M20 for driving the conveying belt 701, an assist motor M21 for driving the assist member 710, and a grip motor M22 for vertically driving the upper gripper 706. Further, there are provided a flattening motor M23 for driving the crimping roller 709, a discharge motor M24 for driving the discharge conveying roller 702, and a conveyer motor M25 for driving the conveyer belt 721. There are also provided input signals such as an inlet sensor 703, a registration sensor 704, a discharge sensor 705 and a conveyer sensor 725 for detecting passage of a sheet.

(Flow of Flattening Processing Operation)

A flow of flattening processing operation will be described next. FIGS. 13 to 16 are sectional views and plan views for describing the flattening processing operation.

Figure 13A:
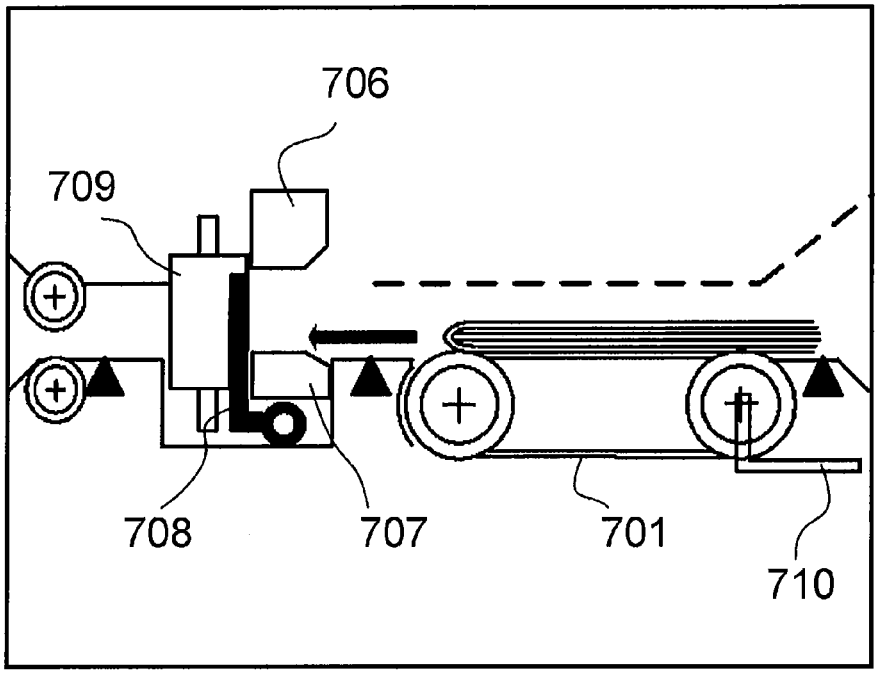
FIGS. 13A and 13B are a sectional view and a plan view, respectively, illustrating a flow of a paper sheet of the flattening apparatus.
Figure 13B:
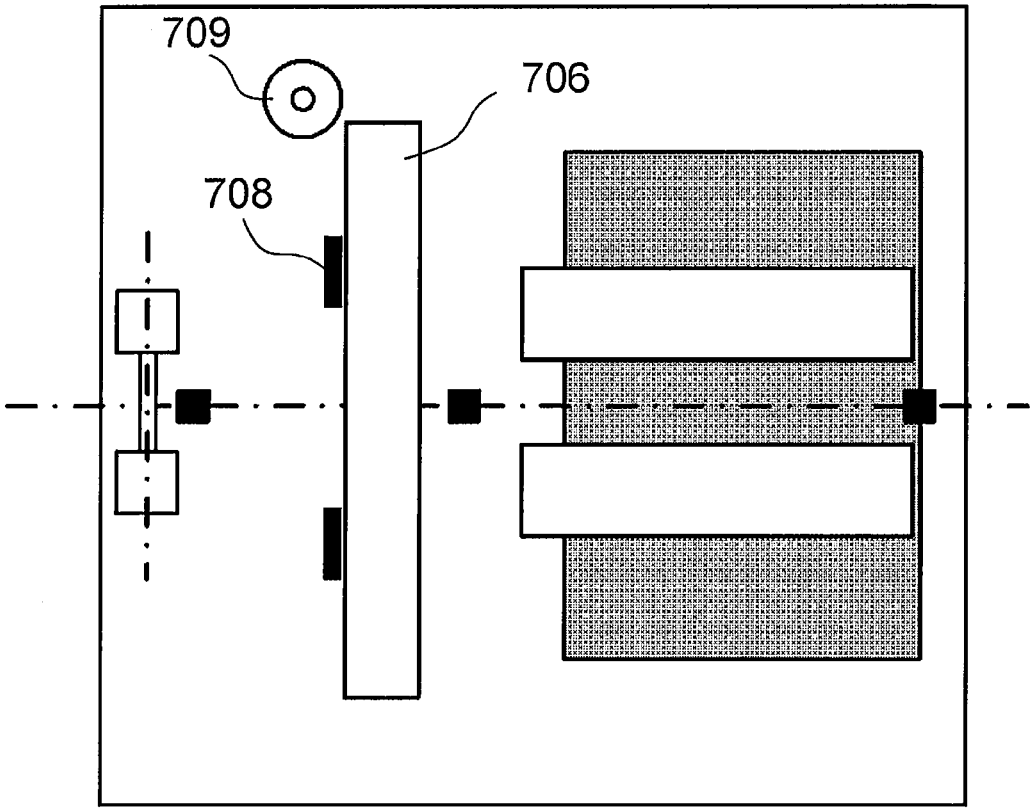

As shown in FIGS. 13A and 13B, a folded sheet bundle B is delivered from the finisher 500 to the conveying belt 701 at a center as a reference in the widthwise direction of the sheet. At that time, the upper gripper 706 is in standby at a lifted position, and the lower grip 707 and the upper gripper 706 are opened. The registration removing stopper 708 has already moved to a registration removing position and on standby. The assist member 710 is in standby at a position retreated to a lower side from a belt surface where the conveying belt 701 comes into contact with a sheet bundle B. If the conveying belt 701 conveys and it is detected that rear ends of the sheet bundle B passed through the inlet sensor 703, the assist member 710 is driven at a constant speed with the conveying belt 701, the conveying belt 701 moves to a protruding position, and the assist member 710 moves to follow the rear ends of the sheet bundle B.

Figure 14A:
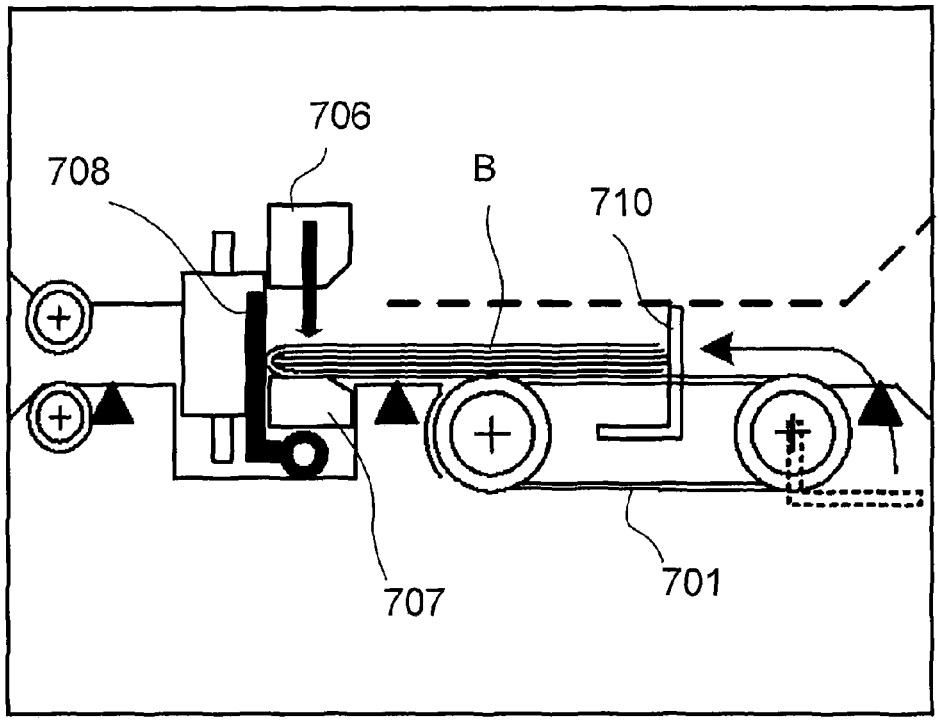
FIGS. 14A and 14B are a sectional view and a plan view, respectively, illustrating a flow of a paper sheet of the flattening apparatus.
Figure 14B:
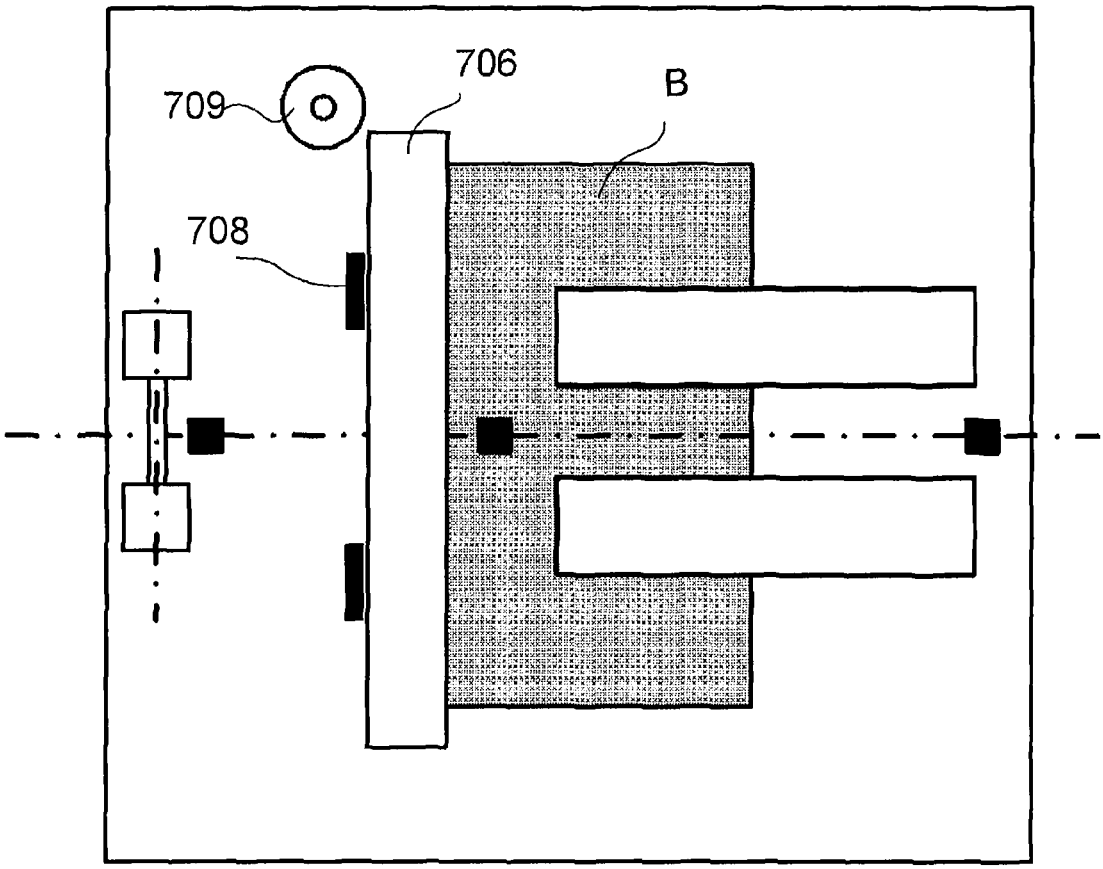

As shown in FIGS. 14A and 14B, the sheet bundle B is conveyed by the conveying belt 701 and the rear ends of the sheet bundle B are pushed by the assist member 710, the sheet bundle B abuts against the registration removing stopper 708 and inclination thereof is removed. Next, the conveying belt 701 and the assist member 710 are stopped, the upper gripper 706 is lowered and the sheet bundle B is fixed.

Figure 15A:
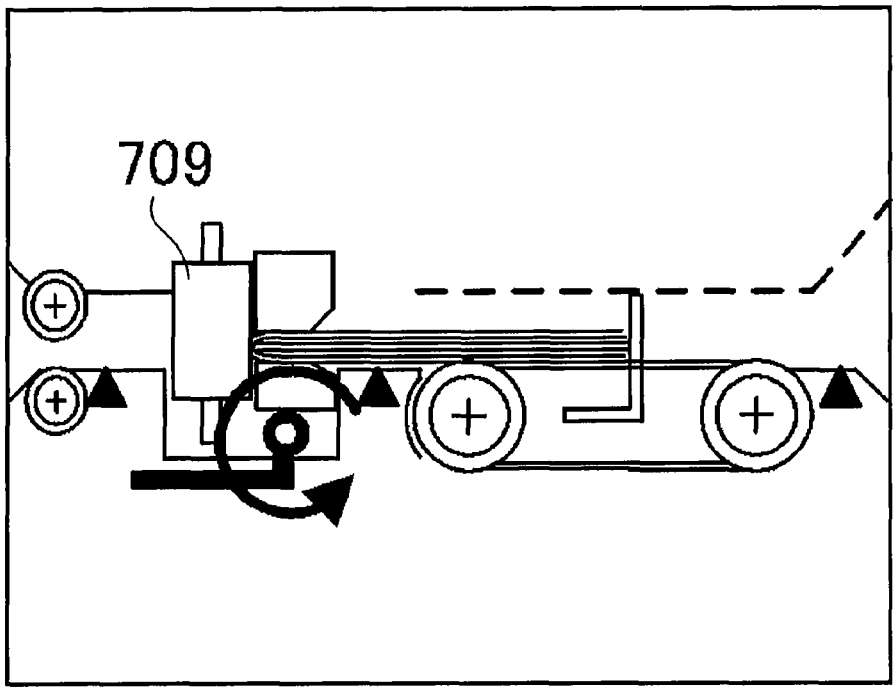
FIGS. 15A and 15B are a sectional view and a plan view, respectively, illustrating a flow of a paper sheet of the flattening apparatus.
Figure 15B:
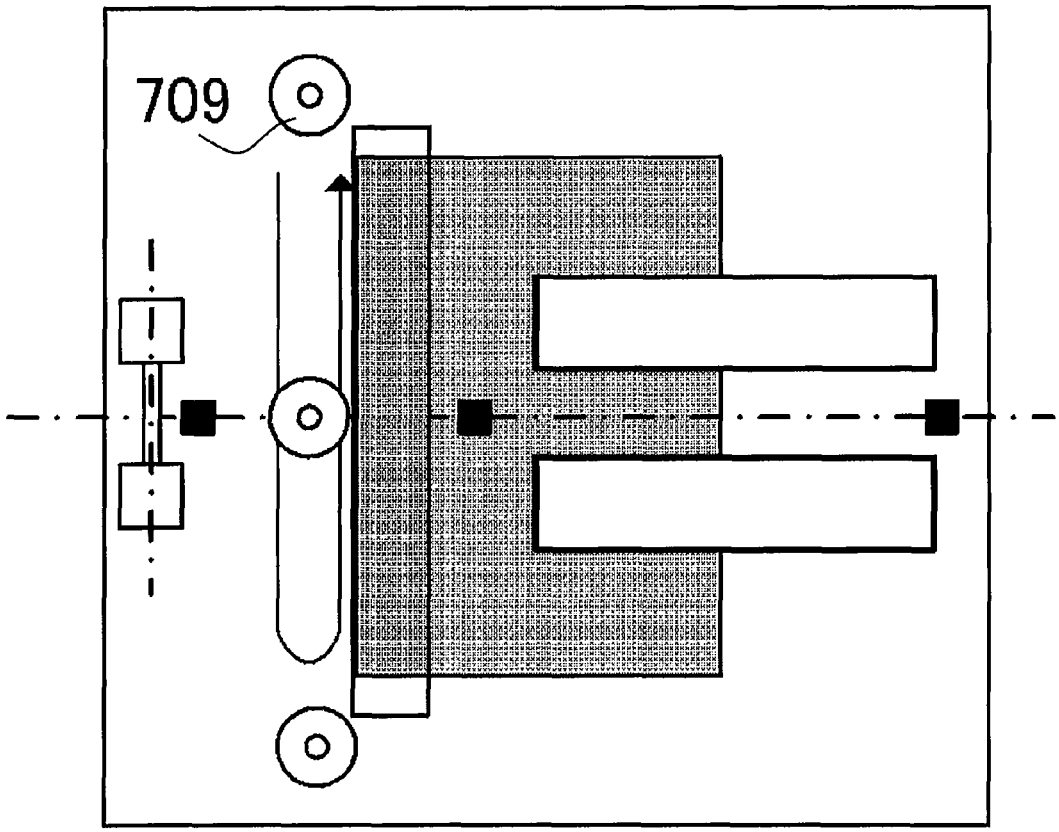

Next, as shown in FIGS. 15A and 15B, to move the crimping roller 709 along a back surface of the sheet bundle B, the registration removing stopper 708 is retreated. The crimping roller 709 crimps the folded surface of the sheet bundle B protruded from the lower grip 707 and the upper gripper 706 and moves the same from the deep side of the apparatus to the front side, and from the front side to deep side, thereby performing out the flattening processing.

Figure 16A:
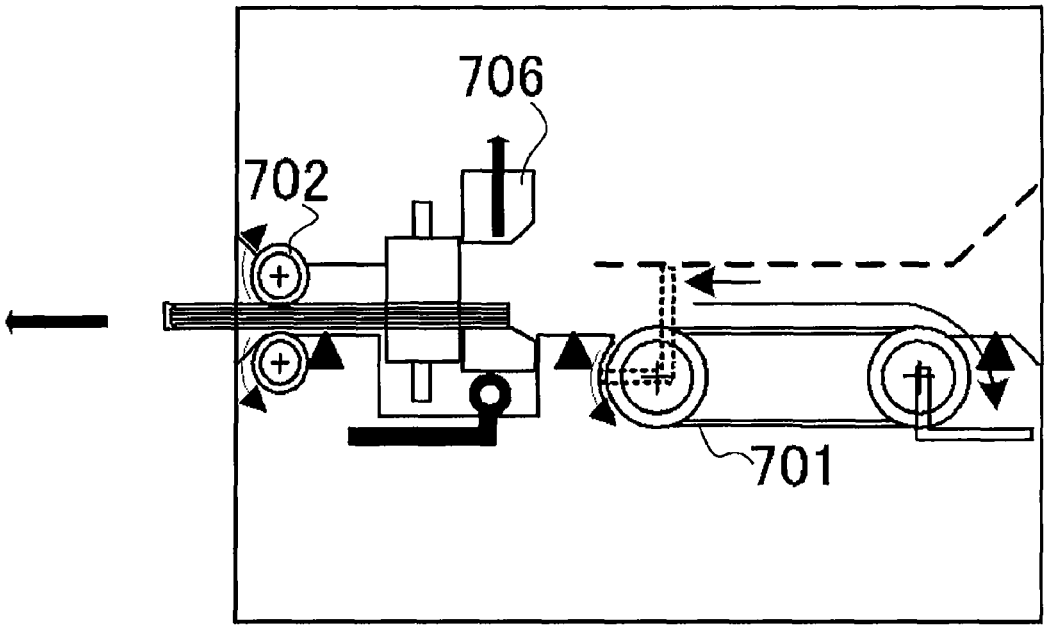
FIGS. 16A and 16B are a sectional view and plan view, respectively, illustrating a flow of a paper sheet of the flattening apparatus.
Figure 16B:
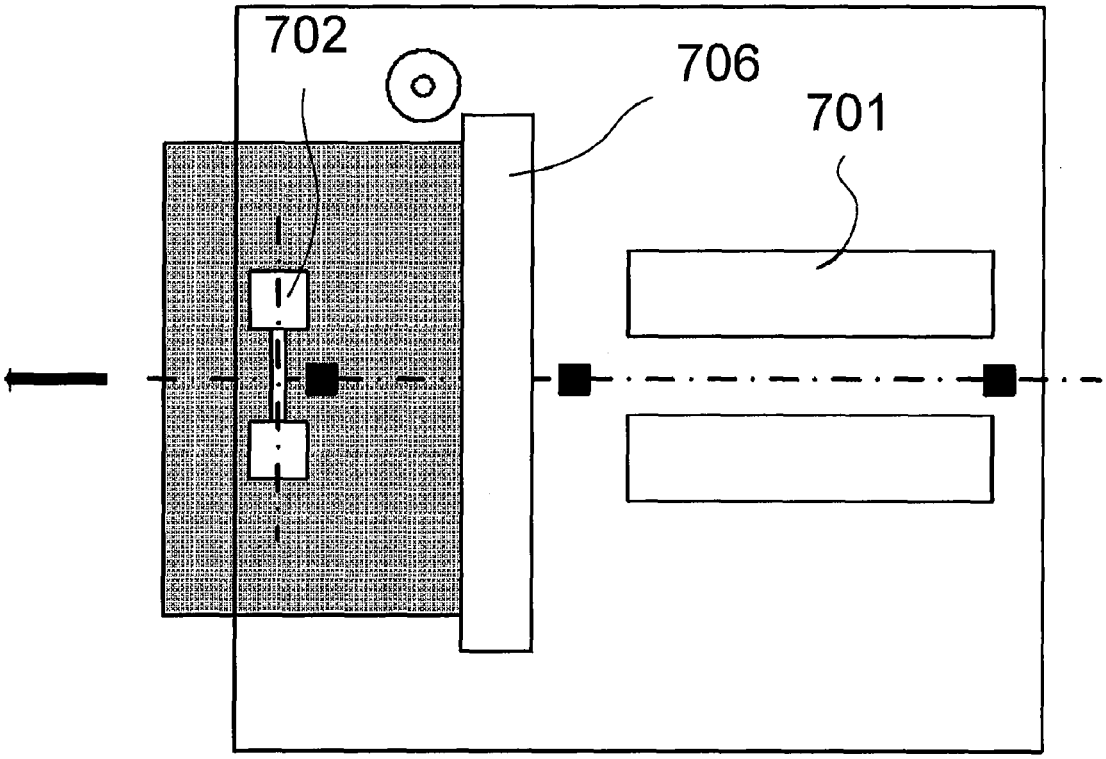

Next, if the flattening processing is completed, as shown in FIGS. 16A and 16B, the upper gripper 706 is moved upward to release the grip of the sheet bundle B, the conveying belt 701 and the assist member 710 are driven, and the sheet bundle B is conveyed downstream. At the same time, the discharge conveying roller 702 is also driven and it is discharged to the loading tray 720. If the tip ends of the sheet bundle B reach the discharge conveying roller 702, the assist member 710 stops driving the same downstream, the assist member 710 is reversely driven and returned to a standby position shown in FIGS. 13A and 13B, and a next sheet bundle can be received.

(Setting of Binding Mode)

Next, a flow of setting of the binding mode will be described with reference to FIGS. 17 to 19.

Figure 17:
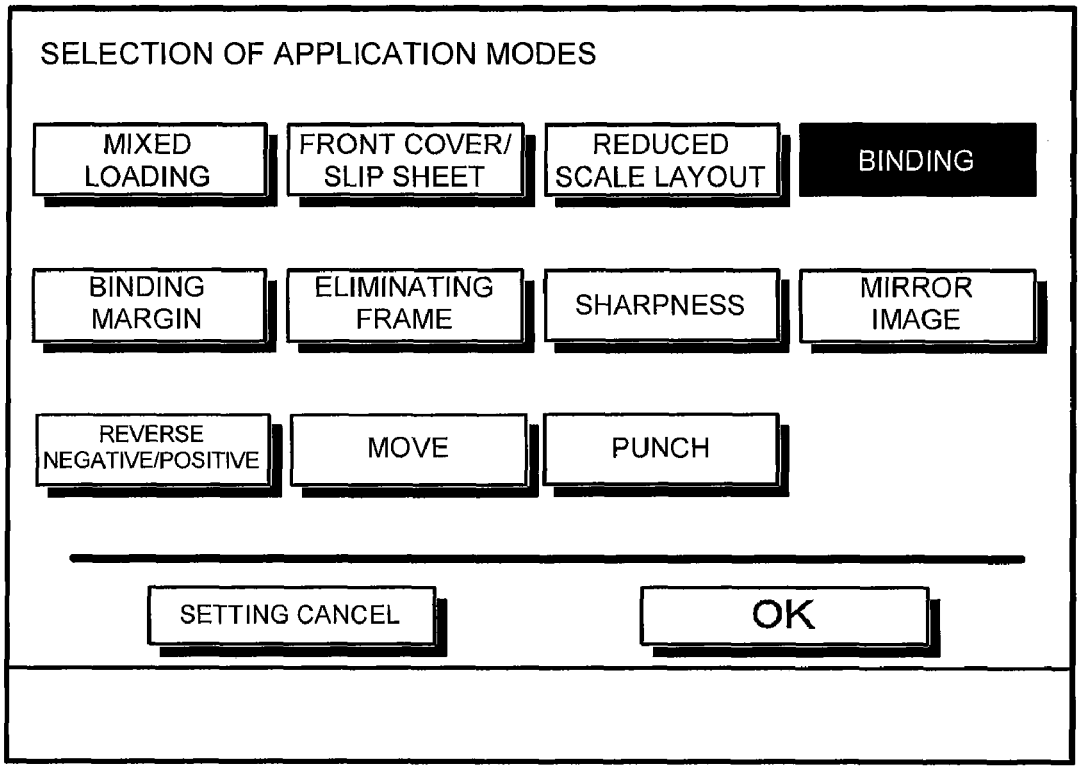
FIG. 17 is an explanatory diagram of a setting screen of the binding mode.
Figure 18:
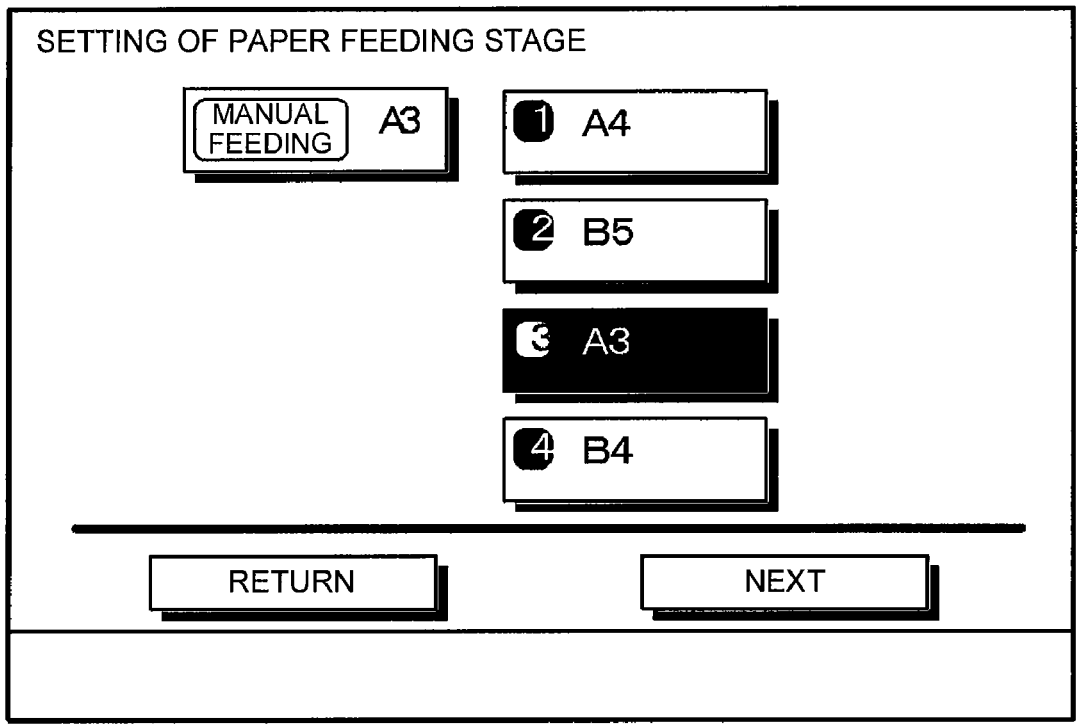
FIG. 18 is an explanatory diagram of the setting screen of the binding mode.

If an "application mode" which is a soft key on the initial screen shown in FIG. 3 is selected, the liquid crystal display portion 420 is switched to a screen on which various modes as shown in FIG. 17 are selected. Here, if "binding" is selected, a key which can select a cassette in which recording sheets to be output are accommodated is displayed as shown in FIG. 18. Here, if a cassette in which sheets of a size to be used is selected and a "next" soft key is pressed, a screen for setting processing a bound sheet bundle is displayed as shown in FIG. 19.

If the binding mode is selected, at least the folding operation is performed, but a user can select whether the stitching operation should be performed, and one of "stitching" and "no stitching" is selected.

There is also provided a flattening setting portion so that a user can select whether the flattening processing should be performed. From the setting screen shown in FIG. 19, one of "flattening processing" and "no flattening processing" is selected to decide whether the flattening processing should be performed.

Then, if "OK" is pressed, the setting is completed, the screen is returned to the initial screen, the start key 402 is pressed and a user waits until an operation is started.

(Folding Operation in Accordance with Binding Mode)

Next, the folding processing by the binding processing portion in accordance with a mode which is set in the binding mode will be described.

Figure 20:
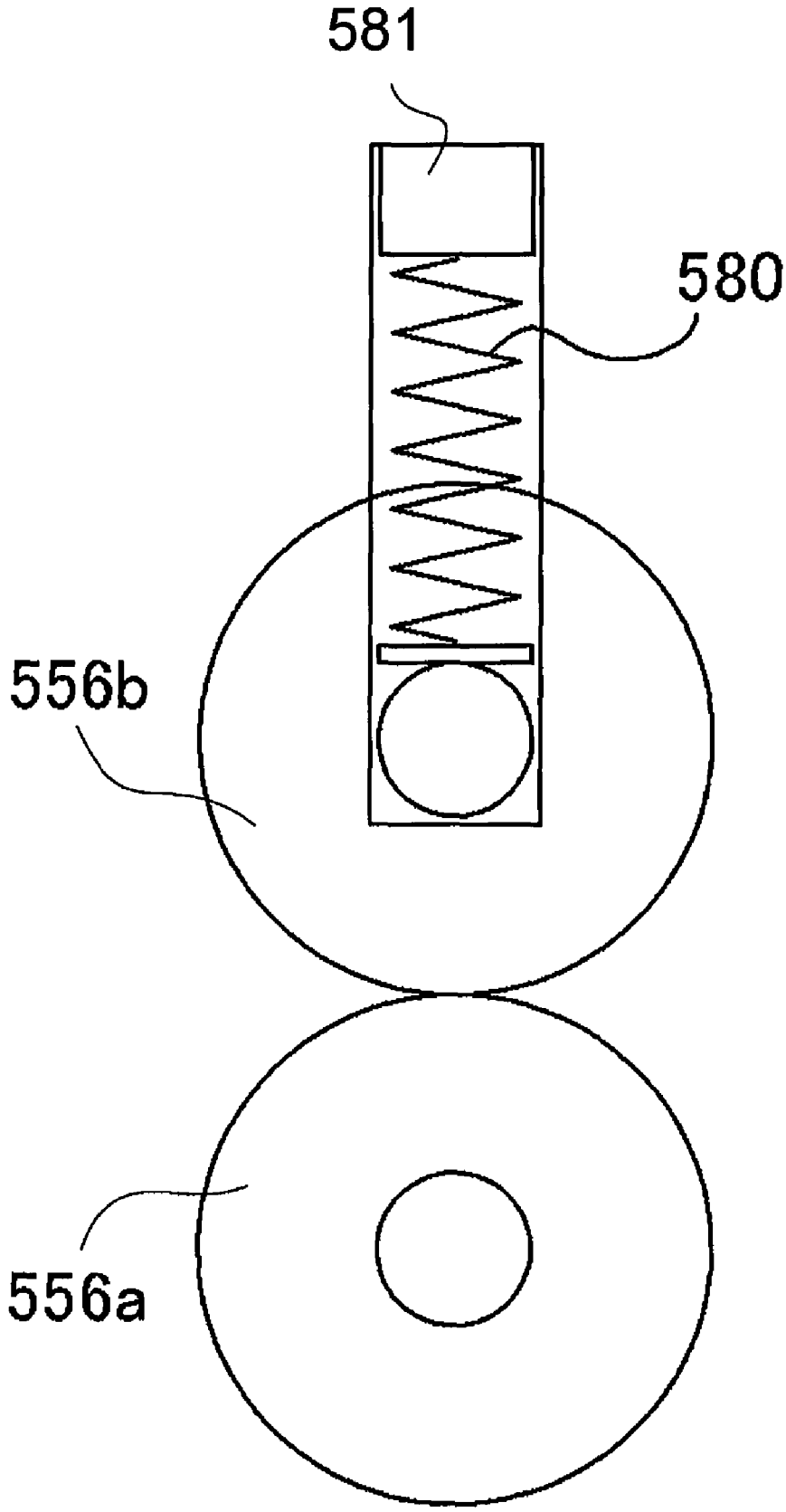
FIG. 20 is a diagram illustrating an operation of a folding roller in accordance with the binding mode.
Figure 21:
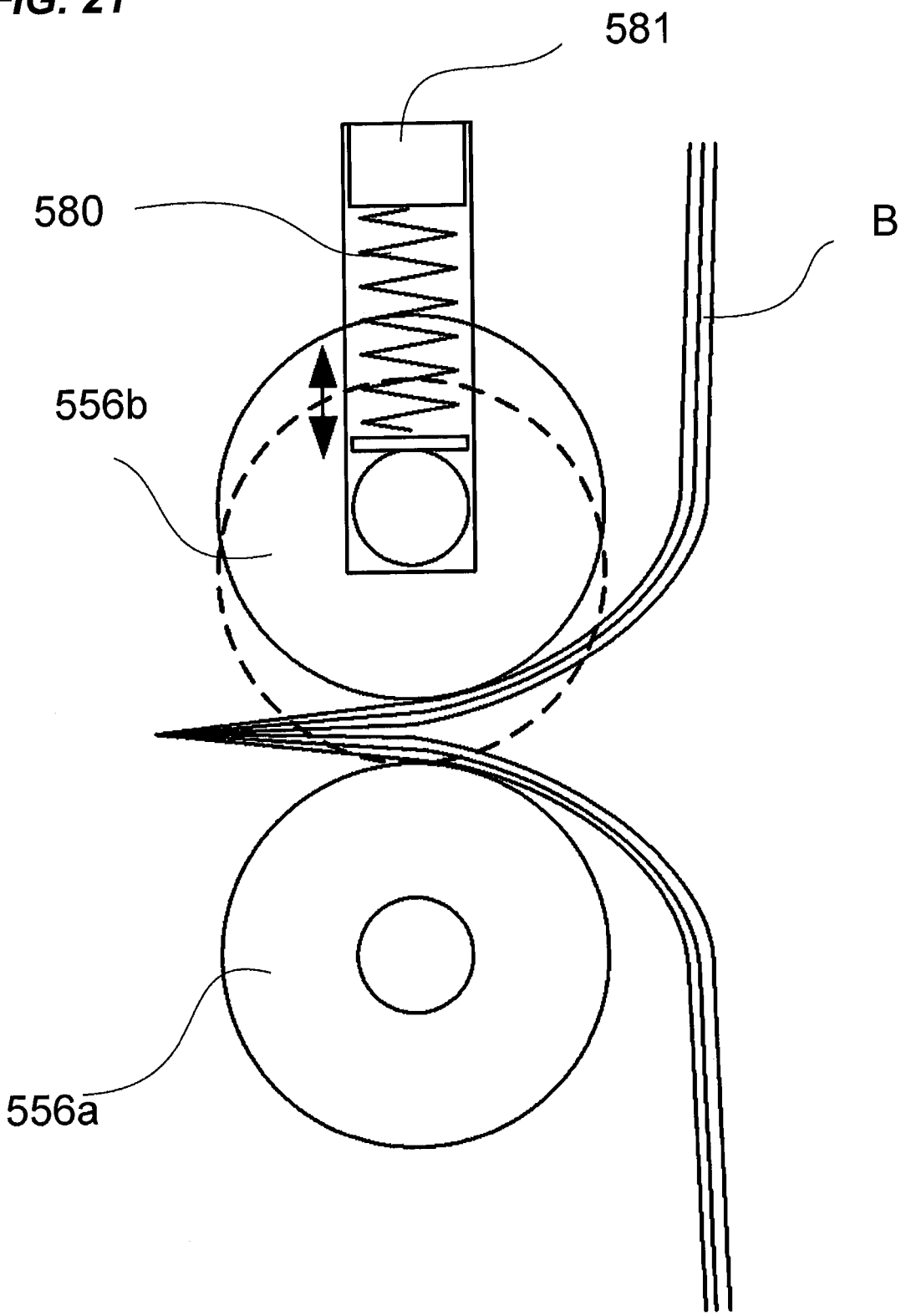
FIG. 21 is a diagram illustrating the operation of the folding roller in accordance with the binding mode.

The folding operation in the binding mode is performed by nipping the finisher 500 by the pair of folding rollers 556. As shown in FIG. 20, the pair of folding rollers 556 includes a lower folding roller 556*a*, and the lower folding roller 556*a* fixes a shaft. The upper folding roller 556*b* biases a roller shaft toward the folding roller 556*a* (downward) by a spring 580. This is because, as shown in FIG. 21, the pair of folding rollers 556 can press and move upward in accordance with the thickness of the bound sheet bundle entering in between nips of the pair of folding rollers 556 from a position (broken line) where the upper folding roller 556*b* is initially crimped.

There is provided a switching portion for switching the nipping pressure on a sheet bundle by the pair of folding rollers 556 which is a folding unit. As shown in FIG. 20, the sheet P has an arm 581 which supports the rotation shaft of the upper folding roller 556*b* can vertically move, and the arm 581 is vertically moved by the separating motor M13 and can be fixed.

In this embodiment, the switching portion switches between a crimping state where the pair of folding rollers 556 is crimped and a separated state where the pair of folding rollers 556 are separated from each other at a predetermined distance.

Figure 19:
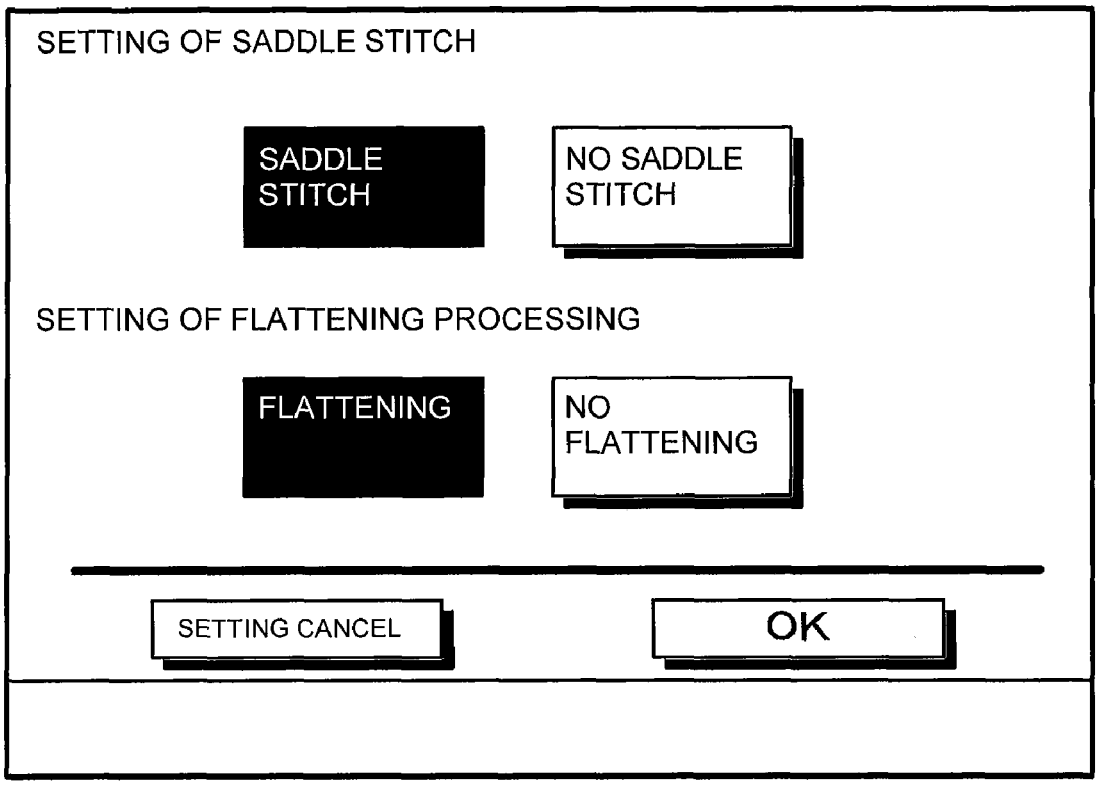
FIG. 19 is an explanatory diagram of the setting screen of the binding mode.

When "no flattening processing" is selected in the setting of the binding mode shown in FIG. 19, the upper and lower folding rollers 556*a* and 556*b* are in the clamping state such that the pair of folding rollers 556 obtain the maximum folding pressure. If the bound sheet bundle enters in between the roller nips in this state, the folding processing is performed in a state where the maximum folding pressure is applied.

Figure 22:
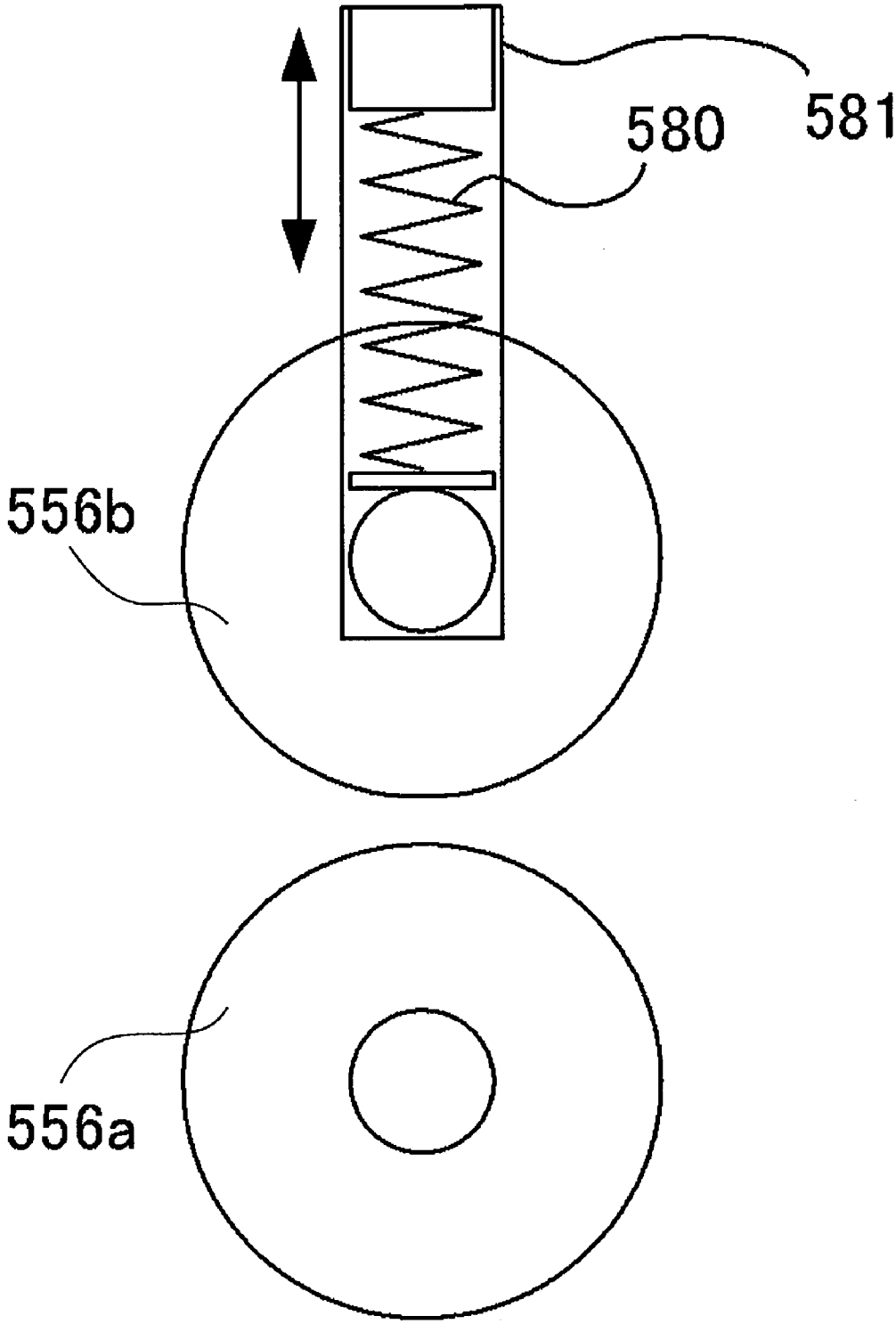
FIG. 22 is a diagram illustrating the operation of the folding roller in accordance with the binding mode.
Figure 23:
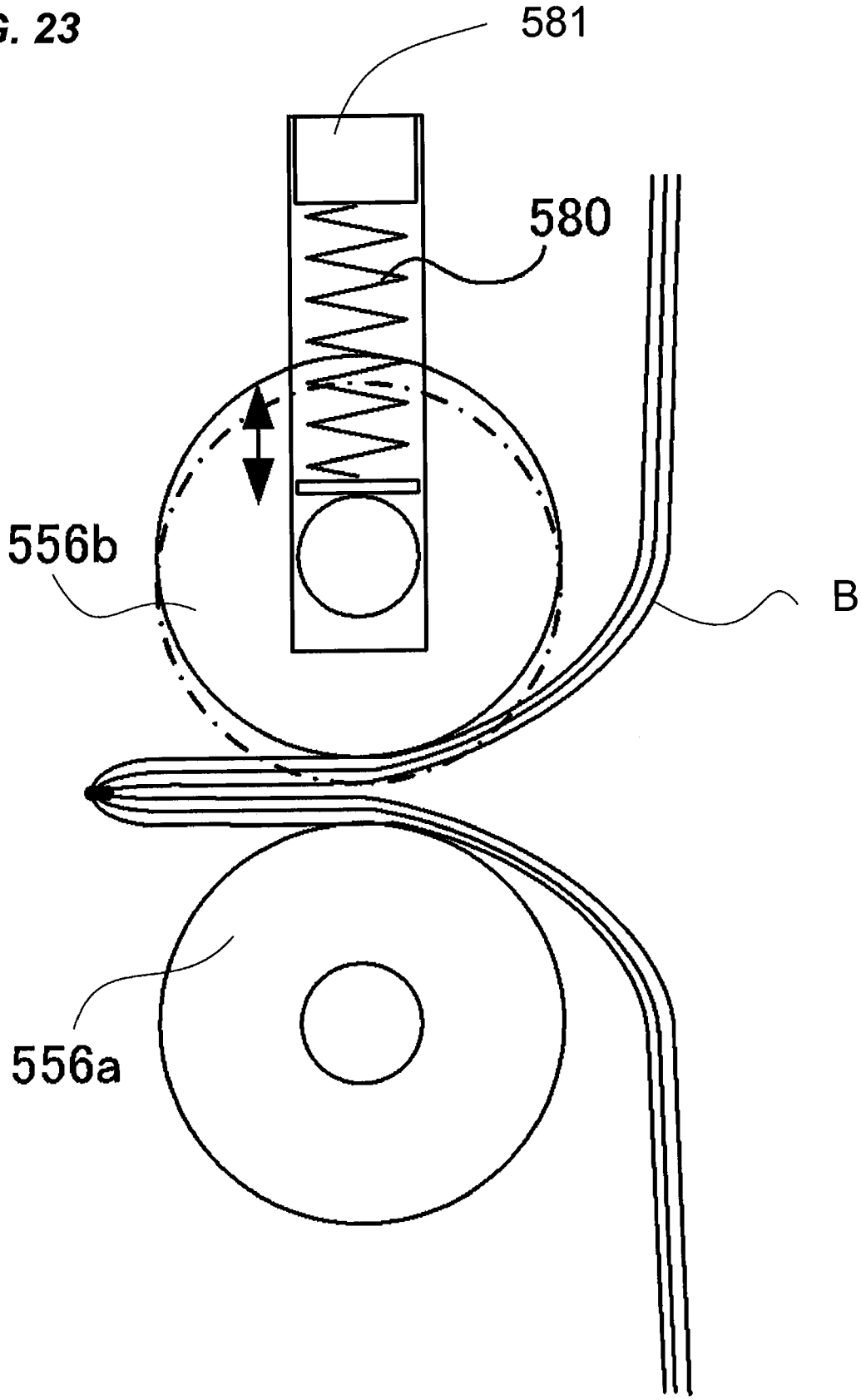
FIG. 23 is a diagram illustrating the operation of the folding roller in accordance with the binding mode.

If the "flattening processing" is selected in the binding mode in FIG. 19, the arm 581 which supports the roller shaft of the upper folding roller 556*b* is moved upward by driving the separating motor M13 as shown in FIG. 22. In this state, the lower folding roller 556*a* and the upper folding roller 556*b* are not in contact with each other and they are separated from each other in this state, the separated position is defined as the initial position and a distance between these rollers is not reduced anymore. As shown in FIG. 23, the folding processing of a sheet bundle accommodated in the binding processing tray 560 is performed at this initial position (chain line). At that time, a sheet bundle enters between the nips of the separated upper and lower folding rollers 556*a* and 556*b*, and the upper folding roller 556*b* is vertically moved by the spring 580 in accordance with thickness of the sheet bundle.

Figure 24:
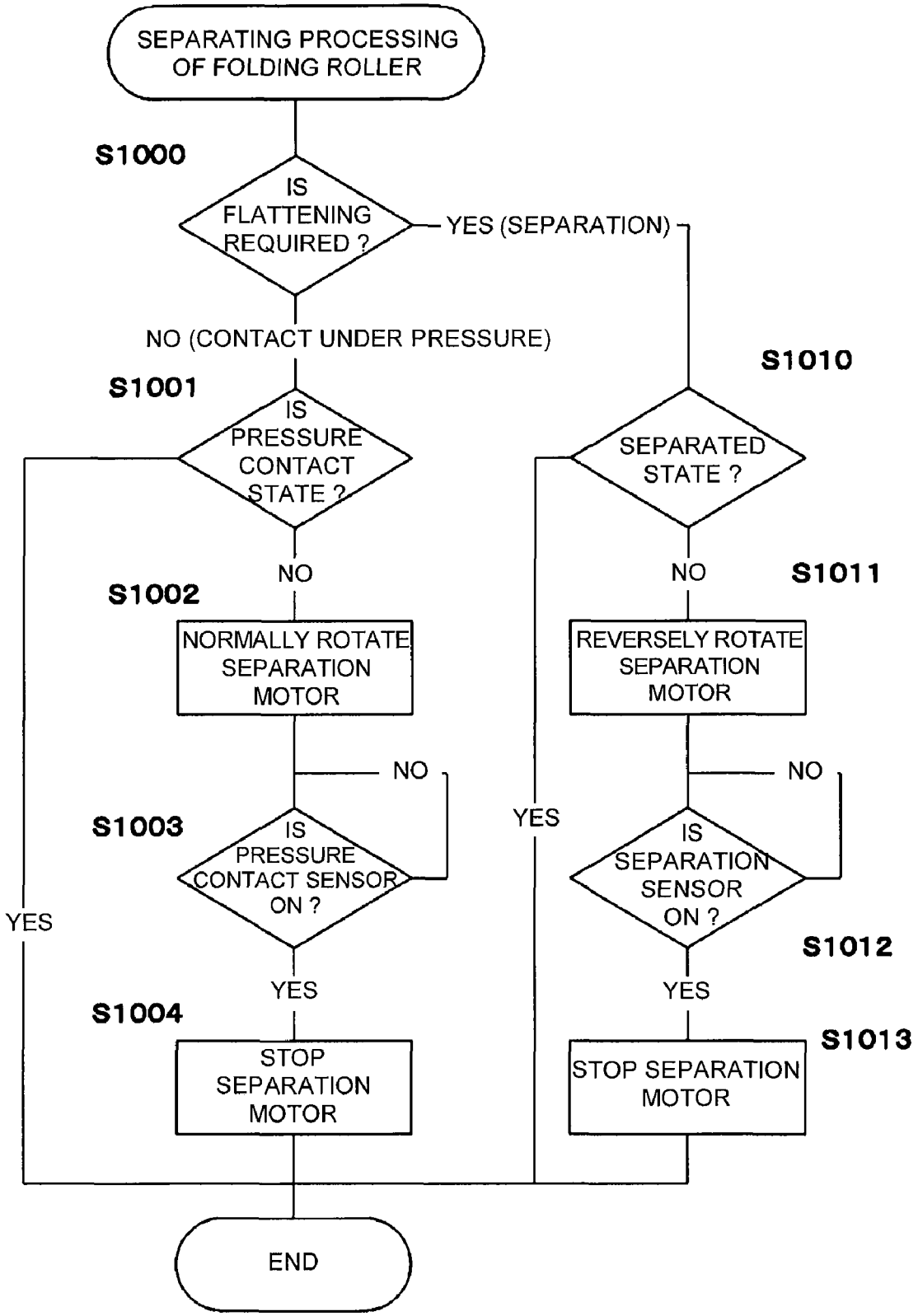
FIG. 24 is a flowchart of separating processing of the folding roller.
Figure 25:
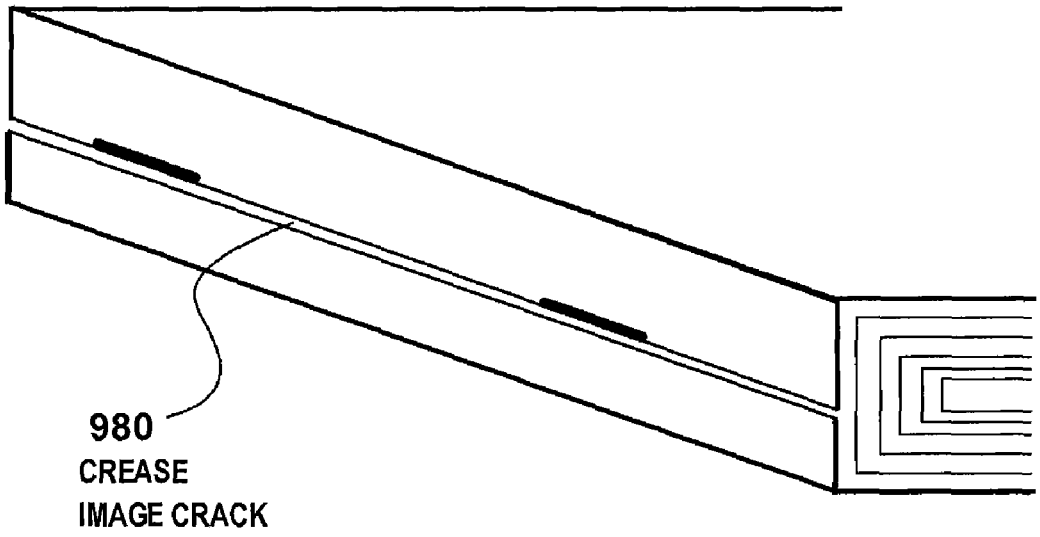
FIG. 25 PRIOR ART
FIG. 25 is an explanatory diagram of a conventional technique.

Concerning the crimping and separating processing of the pair of folding rollers 556, as shown in a flowchart in FIG. 24, it is determined whether a sheet bundle to be processed should be flattened whenever the folding processing is performed (S1000). When the flattening processing is not performed, the processing is advanced to step S1001, and the current state of the pair of folding rollers 556 is determined. If the pair of folding rollers are in the crimping state in step S1001, the processing is completed without driving the separating motor M13.

A crimping sensor (not shown) detects a position of the upper folding roller 556*b* and it is possible to determine if the pressing roller pair is in contacting status or not according the position of the upper folding roller 556*b*. If the crimping sensor is ON, the state is the crimped state, and the crimping sensor is OFF, the state is not the crimped state.

When it is determined in step S1001 that the state is the crimping state, the separating motor M13 is normally rotated and driven. With this, the switching operation into the separating state is started (S1002), and if the crimping sensor is turned ON, it is determined that the upper folding roller 556*b* reaches the crimping position (S1003) and with this, the state is switched to the separated state (S1002), and if the crimping sensor is turned ON, it is determined that the upper folding roller 556*b* reaches the crimping position (S1003), and the driving of the separating motor M13 is stopped (S1004).

When it is determined that the flattening processing should be performed in step S1000, the procedure is advanced to step S1010, and it is determined whether the state of the current pair of folding rollers 556 is the separated state. If it is determined that the pair of folding rollers 556 are in the separated state, the separating motor M13 is not driven and the procedure is completed.

The determination whether the state is the separated state can determine the position of the upper folding roller 556*b* by the separating sensor (not shown), and if the separating sensor is ON, the state is the separated state, and the separating sensor is OFF, the state is not the separated state.

If it is determined that the state is not the separated state in step S1010, the separating motor M13 is reversely rotated and driven, and the switching to the separated state is started (S1011). If the separating sensor is turned ON, it is determined that the upper folding roller 556*b* reaches the separating position (S1012), and the driving of the separating motor M13 is stopped (S1013).

When "flattening processing" is selected, since the pair of folding rollers 556 are separated from each other, the folding pressure of the pair of folding rollers 556 with respect to the sheet bundle is lower than that when "no flattening processing" is selected. A shape of the folded-back surface when "no flattening processing" is selected and the pair of folding rollers 556 crimp (FIG. 21) and a shape of the folded-back surface when the "flattening processing" is selected and the pair of folding rollers 556 are separated from each other (FIG. 23) are different due to the difference in the folding pressure.

In this embodiment, abound sheet bundle is provided with a front cover, and an image is formed on a spine portion. When the spine portion is flattened, since the folding pressure is weaker than that when the flattening processing is not performed, an image on the spine is not cracked.

Although the pair of folding rollers 556 are switched at two locations, i.e., the crimping position and the separating position in this embodiment, when the "flattening processing" is selected, the separating position may be switched in a plurality of stages in accordance with the number of sheets of one sheet bundle accommodated in the binding processing tray. At that time, the thickness of one sheet bundle accommodated in the binding processing tray may be measured, and a plurality of separating positions of the pair of folding rollers 556 may be switched in accordance with the thickness of the sheet bundle. With this, a nipping pressure can be set in accordance with the thickness of a sheet bundle, and it is possible to effectively eliminate a case where a crease remains on a surface of a spine. In a structure where the nipping pressure can be set in accordance with the number of sheets or the thickness of a sheet bundle, the nipping pressure of the same number of sheets and the same thickness of the sheet bundle can be switched depending upon whether the "flattening processing" should be performed.

Although the binding apparatus can stitch and fold, the binding apparatus can also perform the flattening processing only with the folding operation without performing the stitching operation. As a method for binding sheets one sheet by one sheet, starching or string may be used other than stitching.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-273658, filed Oct. 22, 2007, and No. 2008-255882, filed Oct. 1, 2008 which are hereby incorporated by reference herein in their entirety.

What is claimed is:

1. A sheet processing apparatus comprising:

a folding unit which nips and folds a sheet bundle;

a flattening unit which presses a folded-back portion of the sheet bundle folded by the folding unit, thereby flattening the folded-back portion; and a switching portion which switches a nipping pressure of the folding unit against the sheet bundle, wherein the switching portion switches so that the nipping pressure, when the flattening processing is set, is smaller than that when the flattening processing is not set.

2. The sheet processing apparatus according to claim 1, wherein:

the folding unit nips the sheet bundle between a pair of rollers, and the switching portion can change a distance between the pair of rollers.

3. The sheet processing apparatus according to claim 1, wherein the folded sheet bundle is provided with a cover.

4. The sheet processing apparatus according to claim 1, wherein when the flattening processing is set, the switching portion can switch the nipping pressure of the folding unit against the sheet bundle in accordance with a number of sheets in the sheet bundle.

5. The sheet processing apparatus according to claim 1, wherein when the flattening processing is set, the switching portion can switch the nipping pressure of the folding unit against the sheet bundle in accordance with a thickness of the sheet bundle.

6. An image forming apparatus comprising:

an image forming portion which forms an image on a sheet; and a sheet processing apparatus according to claim 1 which folds the sheet on which the image is formed by the image forming portion into two and flattens the sheet.

* * * * *